US006820701B1

(12) United States Patent
Clark et al.

(10) Patent No.: US 6,820,701 B1
(45) Date of Patent: Nov. 23, 2004

(54) VISUAL PROBES AND METHODS FOR PLACING VISUAL PROBES INTO SUBSURFACE AREAS

(75) Inventors: Don T. Clark, Idaho Falls, ID (US); Eugene E. Erickson, Pocatello, ID (US); William L. Casper, Rigby, ID (US); David M. Everett, Shelley, ID (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 43 days.

(21) Appl. No.: 10/285,835

(22) Filed: Nov. 1, 2002

(51) Int. Cl.[7] ..... E21B 47/00
(52) U.S. Cl. ..... 175/49; 73/152.01; 166/250.01
(58) Field of Search ..... 73/152.01; 175/49, 175/50, 40; 166/242.1, 250.01

(56) References Cited

U.S. PATENT DOCUMENTS

| | | | | |
|---|---|---|---|---|
| 3,992,095 A | * | 11/1976 | Jacoby et al. | 356/32 |
| 4,332,160 A | | 6/1982 | Baragar et al. | |
| 5,123,492 A | | 6/1992 | Lizanec, Jr. | |
| 5,128,882 A | | 7/1992 | Cooper et al. | |
| 5,402,165 A | * | 3/1995 | Linville et al. | 348/85 |
| 5,435,176 A | * | 7/1995 | Manchak, III | 73/152.43 |
| 5,439,800 A | * | 8/1995 | Thompson | 435/9 |
| 5,589,825 A | * | 12/1996 | Pomerleau | 340/854.9 |
| 5,739,536 A | | 4/1998 | Bucholtz et al. | |
| 5,902,939 A | | 5/1999 | Ballard et al. | |
| 5,921,328 A | | 7/1999 | Babineau et al. | |
| 6,115,061 A | | 9/2000 | Lieberman et al. | |
| 6,208,940 B1 | | 3/2001 | Kram et al. | |
| 6,230,820 B1 | | 5/2001 | Cordry | |
| 6,236,941 B1 | | 5/2001 | Kram et al. | |

OTHER PUBLICATIONS

Applied Research Associates, Inc., Article Entitled Digital Cones, 1999 as found on the following internet address http://www.vertek.ara.com/products/probes/video.html on Jan. 31, 2002.

Applied Research Associates, Inc., Article entitled Video Cone Penetrometer, 1999.

* cited by examiner

*Primary Examiner*—David Bagnell
*Assistant Examiner*—K. Thompson
(74) *Attorney, Agent, or Firm*—Wells St. John

(57) ABSTRACT

Visual probes and methods for placing visual probes into subsurface areas in either contaminated or non-contaminated sites are described. In one implementation, the method includes driving at least a portion of a visual probe into the ground using direct push, sonic drilling, or a combination of direct push and sonic drilling. Such is accomplished without providing an open pathway for contaminants or fugitive gases to reach the surface. According to one implementation, the invention includes an entry segment configured for insertion into the ground or through difficult materials (e.g., concrete, steel, asphalt, metals, or items associated with waste), at least one extension segment configured to selectively couple with the entry segment, at least one push rod, and a pressure cap. Additional implementations are contemplated.

85 Claims, 11 Drawing Sheets

122
42
74
3
40
44
122
72
40
44
1
72
43
120
150
75
40
44
70
2
10
73

VISUAL PROBES AND METHODS FOR PLACING VISUAL PROBES INTO SUBSURFACE AREAS

CONTRACTUAL ORIGIN OF THE INVENTION

This invention was made with United States Government support under Contract DE-AC07-99ID13727 awarded by the U.S. Department of Energy. The Government has certain rights in the invention.

TECHNICAL FIELD

The invention relates to apparatus and methods which facilitate viewing subsurface areas. The invention also relates to visual probes and methods for placing visual probes into subsurface areas.

BACKGROUND OF THE INVENTION

In the United States, there are hundreds of thousands of waste disposal sites. Many of these waste disposal sites contain buried radiological contaminants or other hazardous materials. Unfortunately, poor waste management and waste disposal practices have allowed dangerous contaminants to migrate from such waste disposal sites into surrounding soils and groundwater.

Effective remediation and/or containment strategies are needed for these waste disposal sites. However, before an effective remediation and/or containment strategy can be developed for a particular waste site, the waste buried at the site should be adequately characterized. Additionally, in many cases, long-term monitoring of the waste site may be appropriate.

Characterization and/or monitoring of a waste disposal site typically involves the use of testing probes placed directly into the subsurface areas of the site for data collection. Several different types of testing probes may be used to assist in characterizing and/or monitoring the subsurface waste. One of these types of testing probes is known as a visual probe. Visual probes are used to visually inspect the physical condition of buried wastes, containers, sludges, and interstitial soils, and to provide information regarding soil moisture and contaminant migration.

Unfortunately, the placement of visual probes directly into the subsurface areas of a waste disposal site which contains buried radiological contaminants or other hazardous materials has been difficult, because placement of such probes would require drilling or coring which may bring contaminated "cuttings" to the surface and may also create a pathway through which contaminated emissions may escape. As a result, rather than placing visual probes directly into such waste sites, the probes have typically been placed around the perimeter of such sites. Unfortunately, such placement only provides information when contaminants have already migrated outside of the waste site area. Moreover, when the contaminants have migrated outside of the waste disposal site area, it is likely that a major contaminant plume exists in the subsurface soil and aquifer making remediation and containment efforts more difficult and costly.

Additionally, typical visual probes are not structurally able to be advanced in difficult materials.

In view of the foregoing, it would be highly desirable to provide methods and apparatus which facilitate viewing subsurface areas in contaminated as well as non-contaminated areas, while substantially avoiding these and other shortcomings of the prior art devices.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 5:
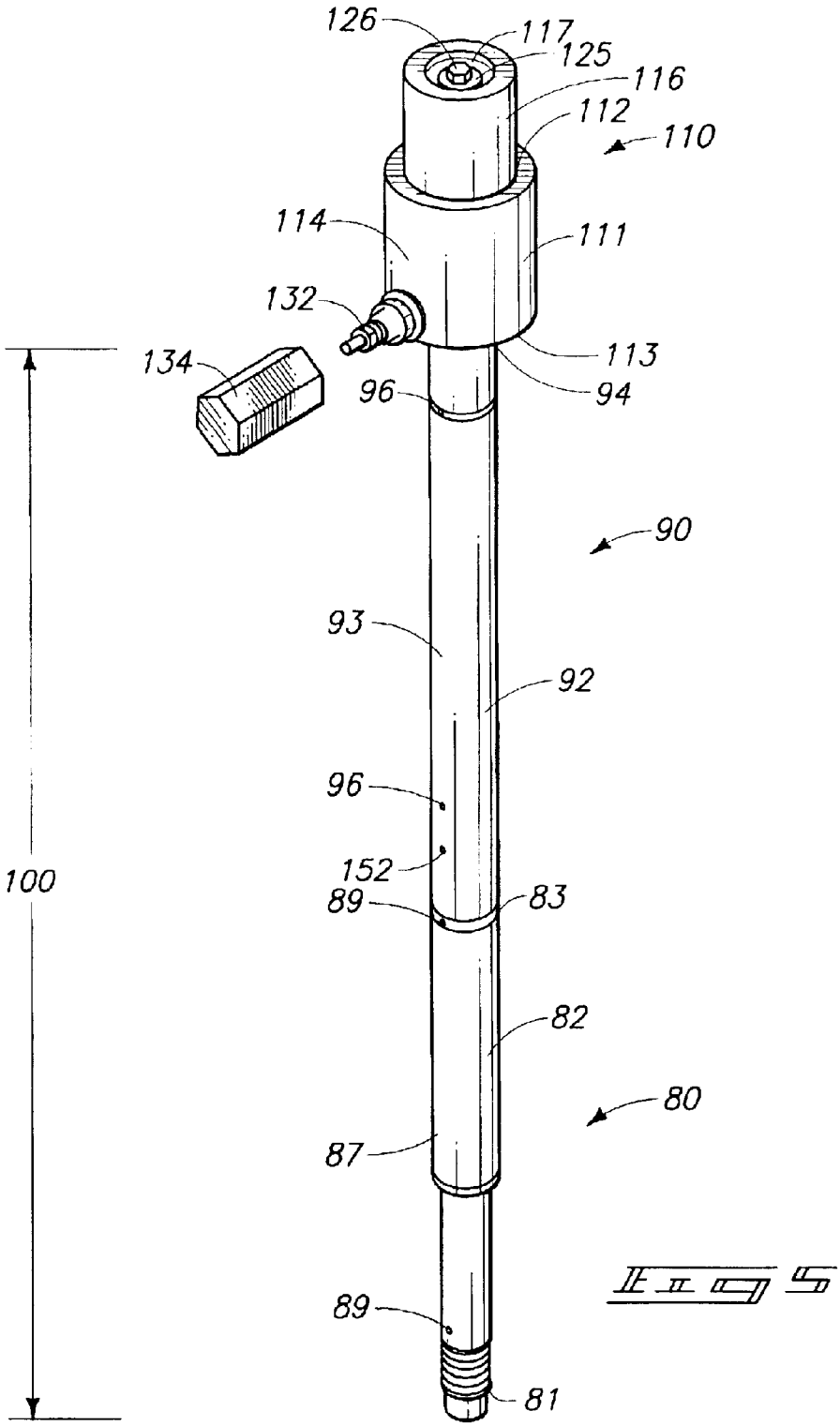
FIG. 5 is a perspective view showing a pressure cap, an entry segment push rod, and an extension segment push rod in accordance with one embodiment of the present invention.
Figure 6:
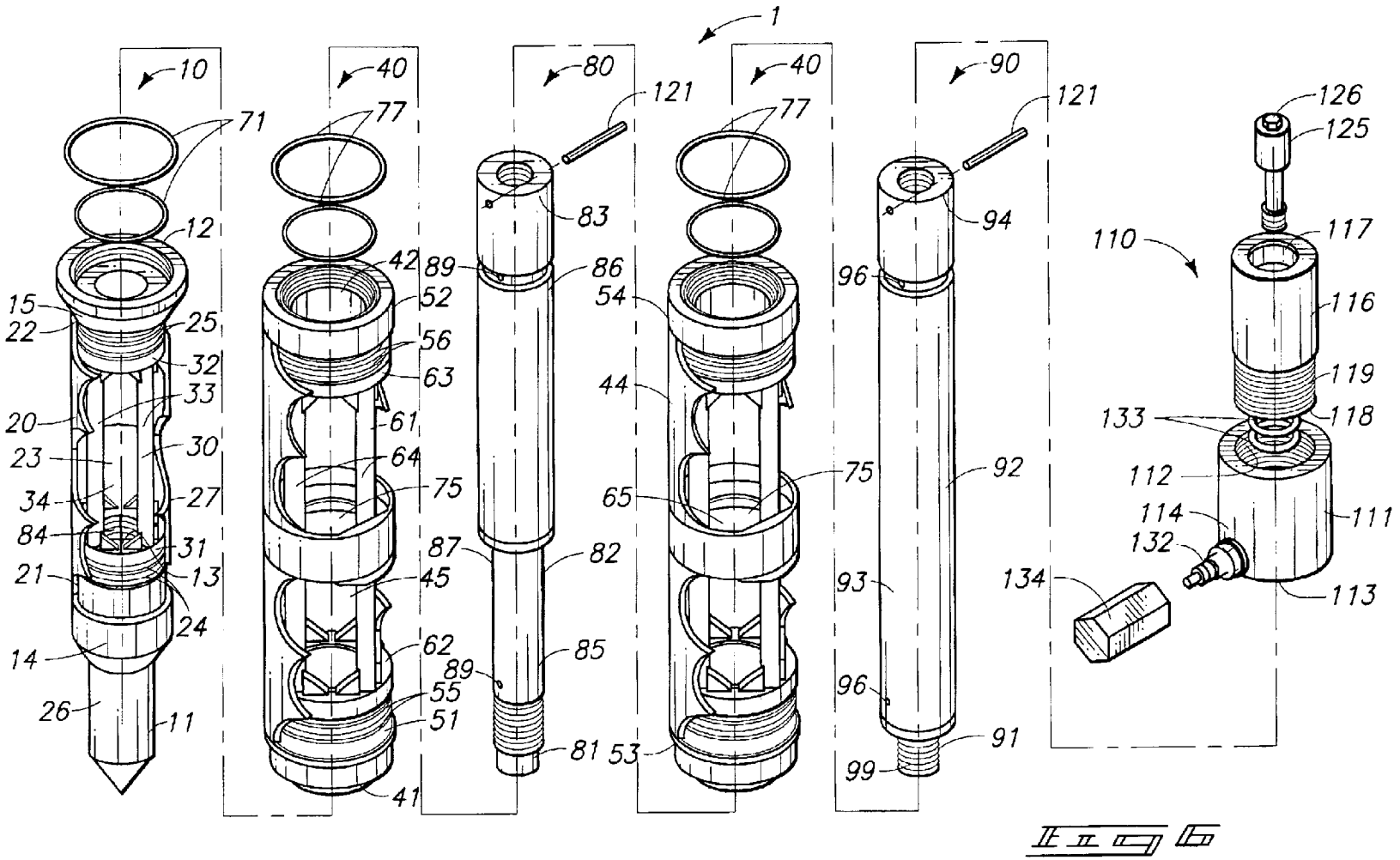
FIG. 6 is an exploded perspective view of a visual probe in accordance with one embodiment of the present invention.
Figure 7:
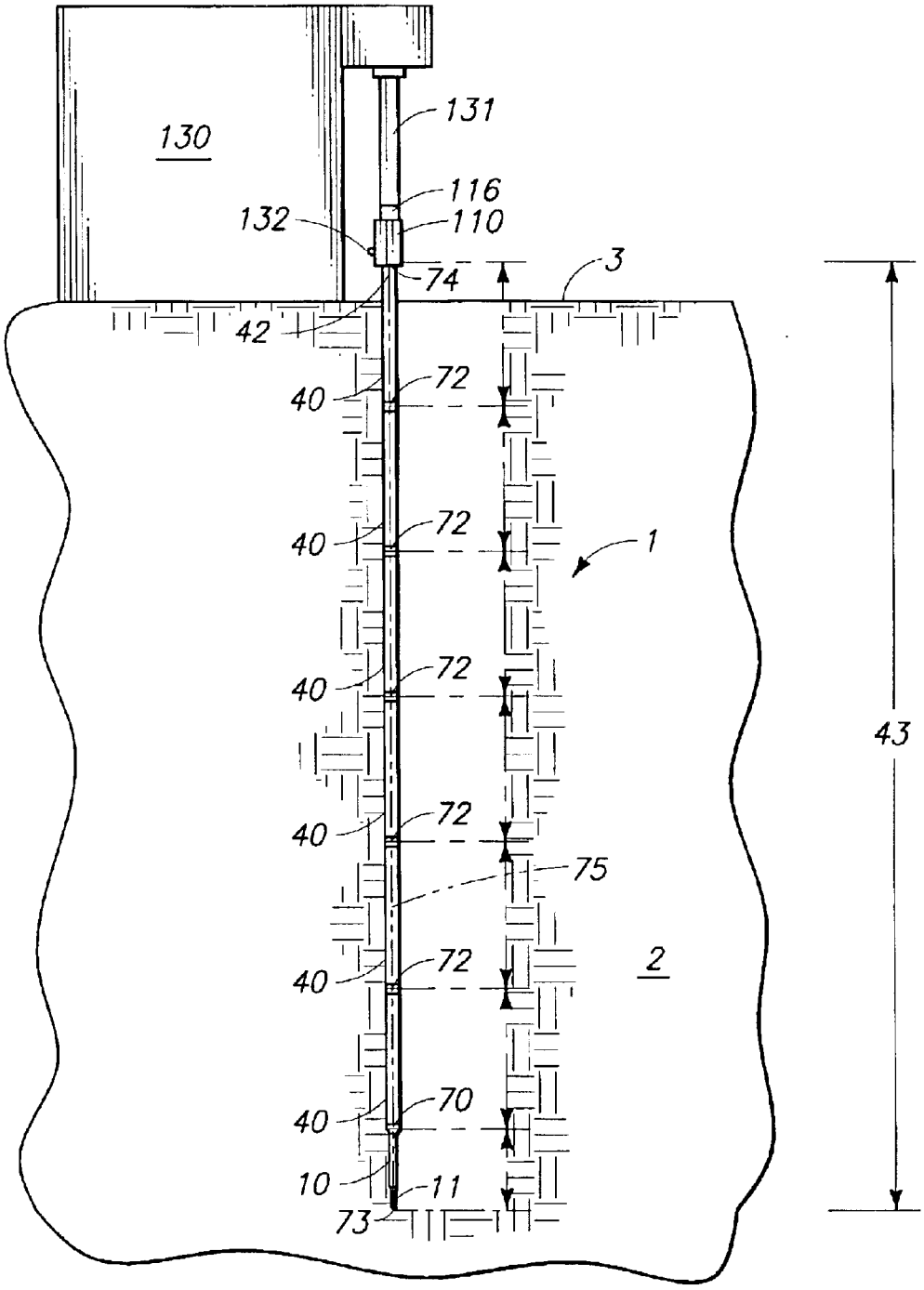
FIG. 7 is a side view showing a visual probe having been placed in a subsurface area in accordance with one embodiment of the present invention.
Figure 8:
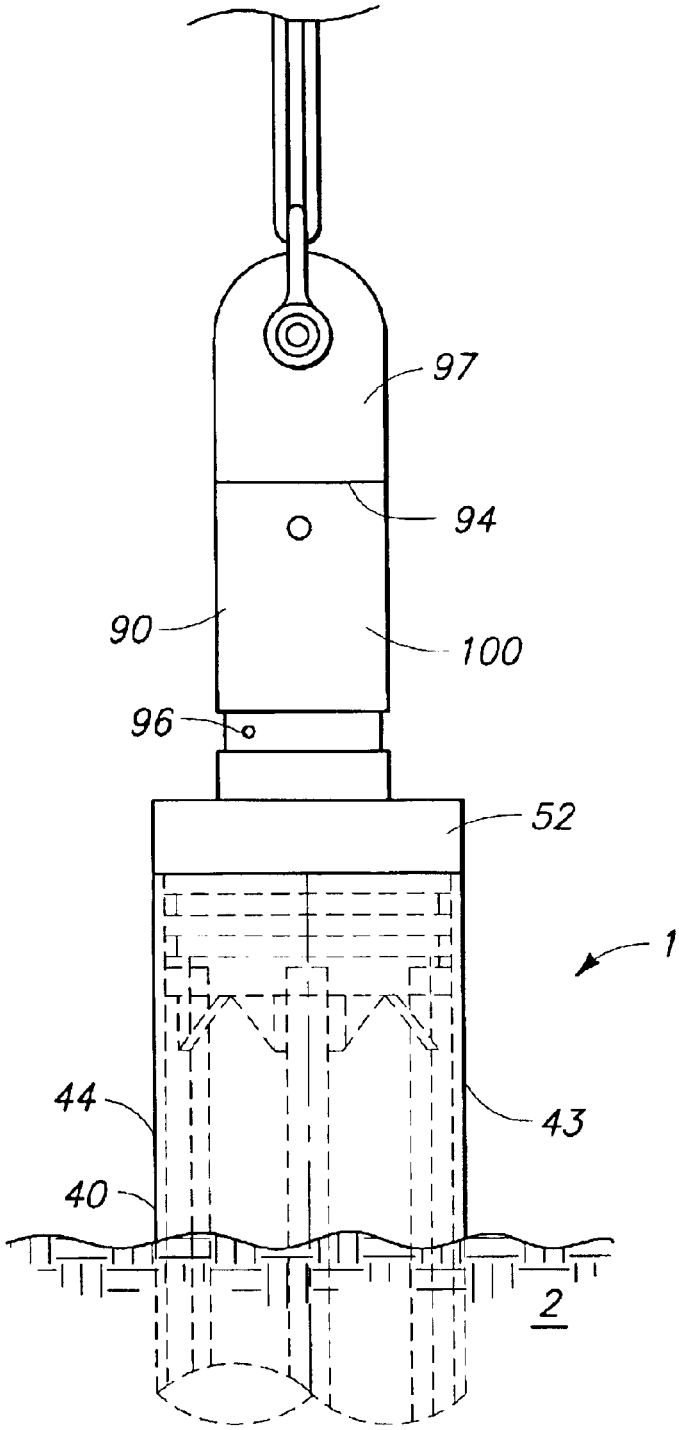
FIG. 8 is a side view showing part of an extension segment and part of a push rod string in accordance with one embodiment of the present invention.
Figure 9:
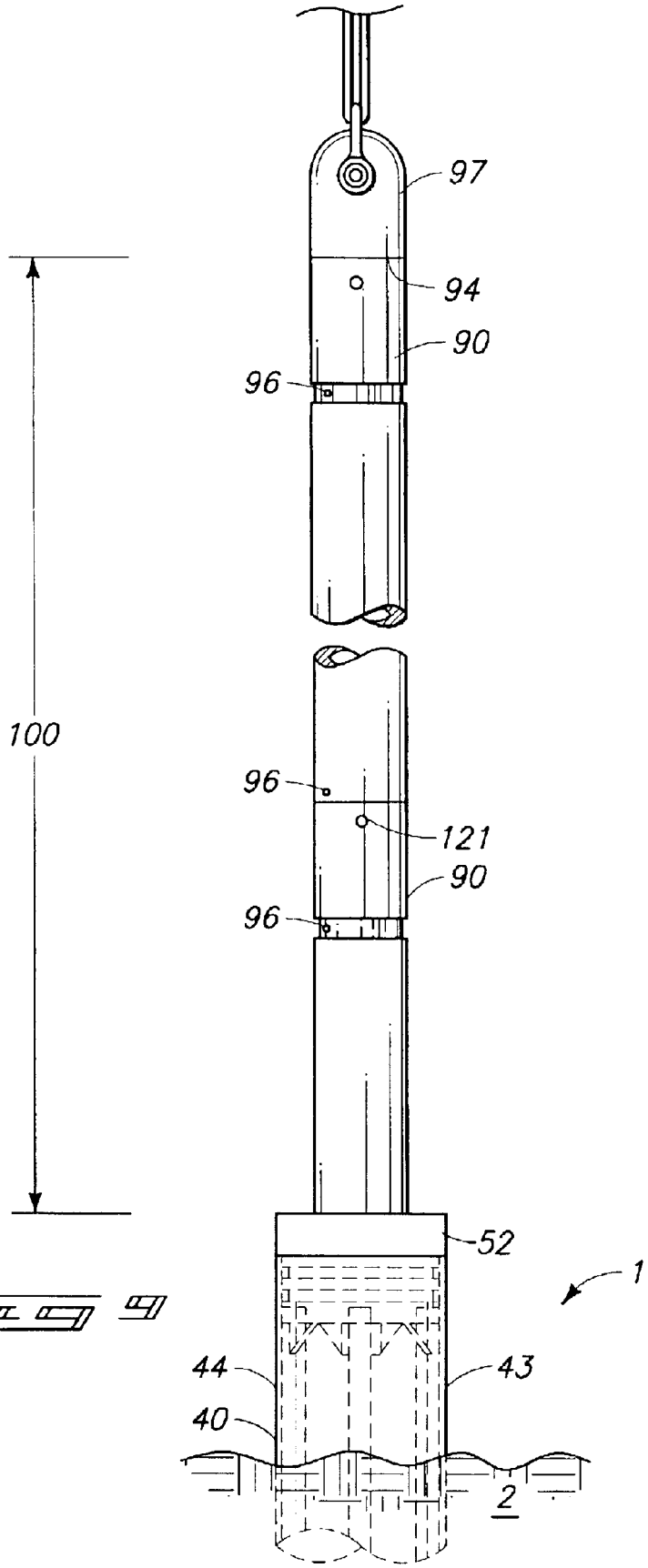
FIG. 9 is a side view showing part of an extension segment and part of a push rod string in accordance with one embodiment of the present invention.
Figure 10:
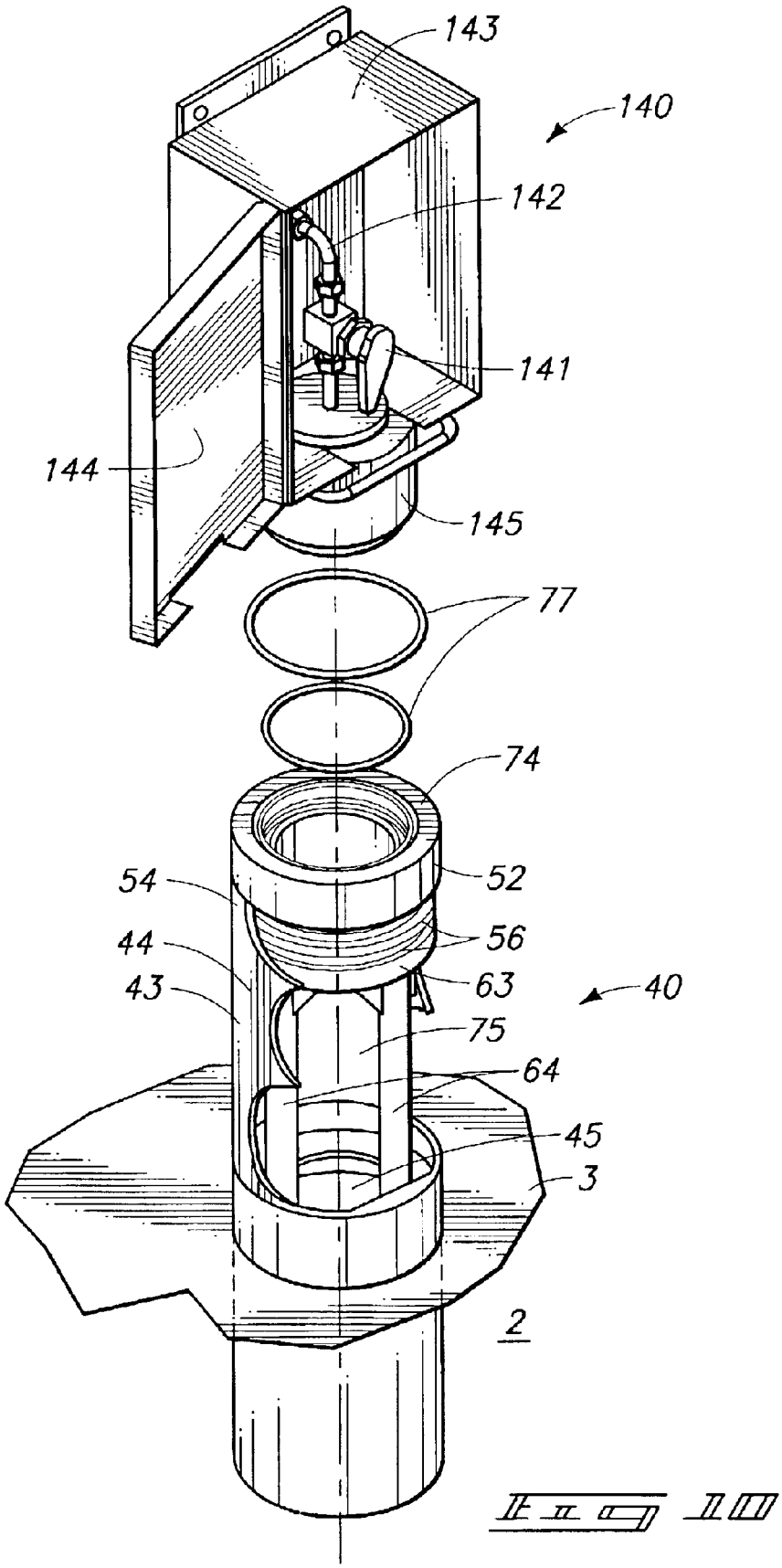
FIG. 10 is a perspective view showing a field cap and part of an extension segment in accordance with one embodiment of the present invention.
Figure 11:
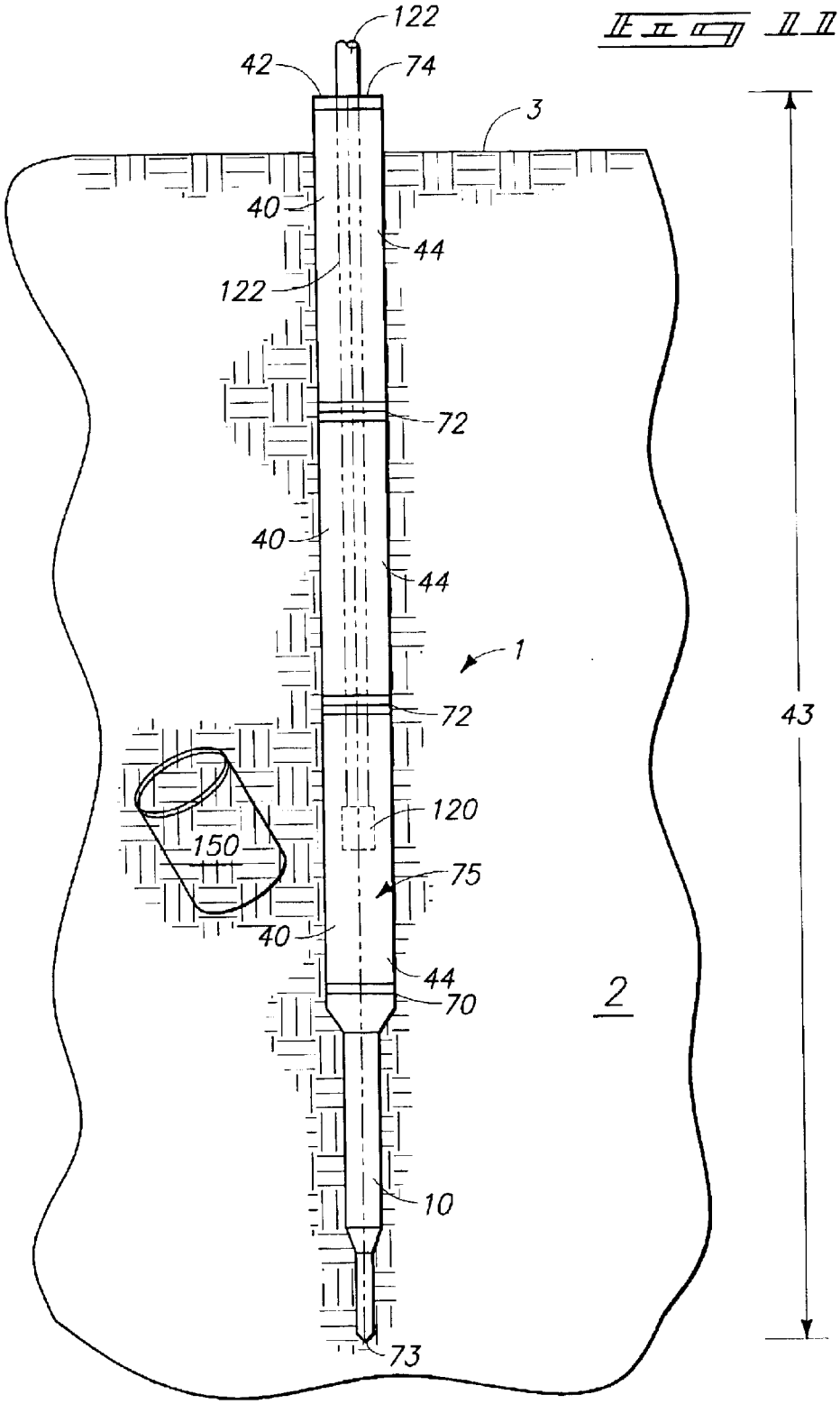
FIG. 11 is a side view showing a visual probe having been placed in a subsurface area in accordance with one embodiment of the present invention.

FIGS. 1–11 depict methods and apparatus which facilitate viewing subsurface areas 2 (e.g., the ground, or other media such as gravel, water, gasses, solutions, etc.) in contaminated or non-contaminated sites. A visual probe for viewing such subsurface areas is generally indicated by the numeral 1, and may best be seen in FIGS. 6, 7 and 11. The visual probe 1 is sufficiently structurally sound and robust to be placed through difficult materials such as areas adjacent gasoline or oil tanks or drums, areas including buried concrete, areas including contaminated waste, etc. The visual probe 1 can be driven into such subsurface areas 2 by direct push, by sonic drilling, or by a combination of direct push and sonic drilling, thereby avoiding the need for prior excavation or drilling procedures which may bring contaminated "cuttings" to the land's surface 3, and which may also create a pathway through which contaminated emissions may escape to the land's surface 3 (FIGS. 7, 10 and 11).

Figure 1:
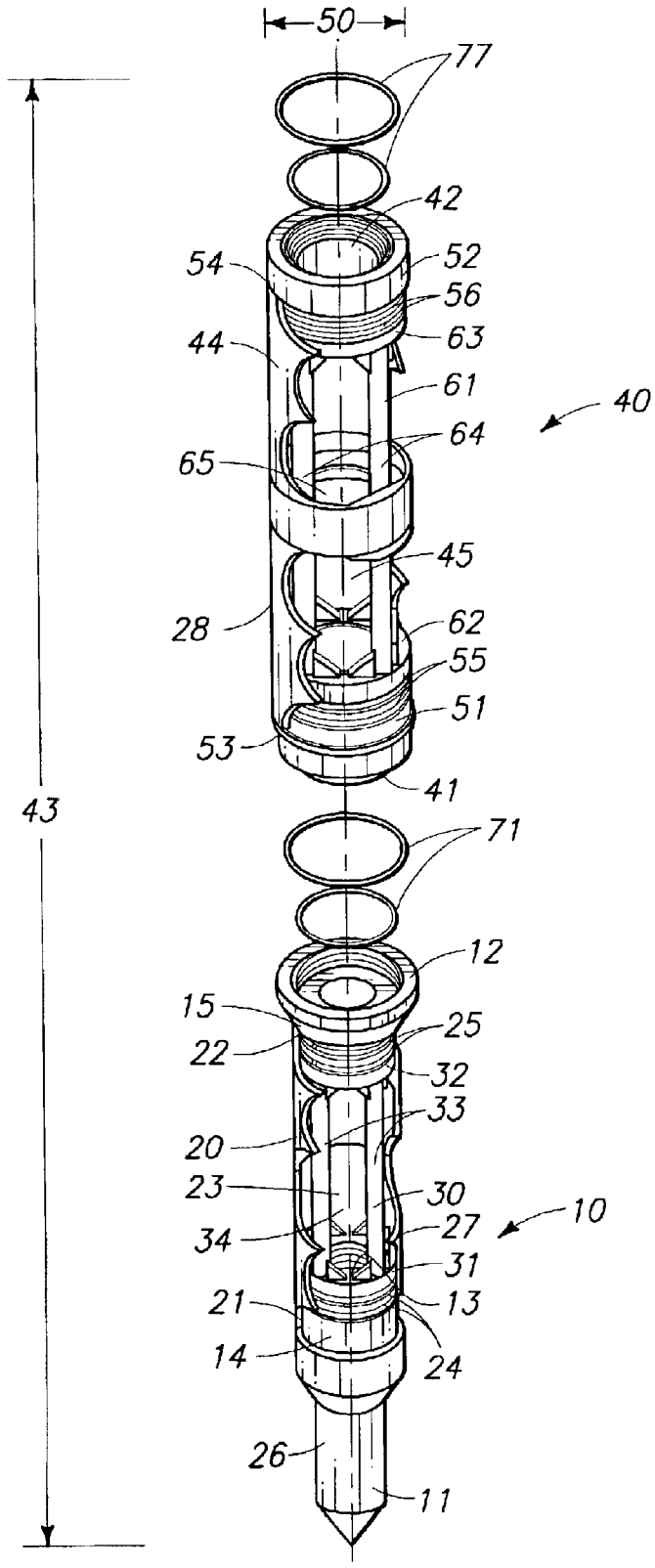
FIG. 1 is a perspective view showing an entry segment and an extension segment in accordance with one embodiment of the present invention.

FIG. 1 shows an entry segment generally indicated by the numeral 10. The entry segment 10 includes a tip end 11 configured for insertion into a subsurface area 2 (FIG. 7), an attachment end 12, and a push rod receiving point 13. The tip end 11 is constructed of steel in one embodiment; however, in alternative embodiments, other materials are employed. The entry segment 10 also includes a first entry segment hub 14 positioned proximate the tip end 11 of the entry segment 10. A second entry segment hub 15 is positioned at the attachment end 12 of the entry segment 10. The entry segment hubs 14 and 15 are constructed of steel in one embodiment; however, in alternative embodiments, other materials are employed. An entry segment sidewall 20 having open ends 21 and 22 extends between the entry segment hubs 14 and 15. In one embodiment, at least a portion of the entry segment sidewall 20 is transparent or translucent. In another embodiment shown in FIG. 1, the entire entry segment sidewall 20 is transparent. In the illustrated embodiment, the transparent entry segment sidewall 20 is constructed of polycarbonate, however, any other suitable material may be utilized.

In FIG. 1, a portion of the entry segment sidewall 20 has been removed so that the underlying structures may be more clearly shown. The open end 21 of the entry segment sidewall 20 is configured to selectively couple with the entry segment hub 14, while the open end 22 of the entry segment sidewall 20 is configured to selectively couple with the entry segment hub 15. Together, the entry segment sidewall 20 and the open ends 21 and 22 define in part an entry segment cavity 23.

The entry segment 10 also includes at least one entry segment hub seal 24 positioned between the open end 21 of the entry segment sidewall 20 and the entry segment hub 14. The entry segment 10 also includes at least one entry segment hub seal 25 positioned between the open end 22 of the entry segment sidewall 20 and the entry segment hub 15. The entry segment hub seals 24 and 25 function as a substantial barrier to contaminants, thus impeding contaminants in the ground from entering the entry segment cavity 23. In the embodiment depicted in FIG. 1, the at entry segment hub seals 24 and 25, each comprise two o-rings. In the illustrated embodiment, these o-rings are constructed of fluorcarbon rubber, however, any other suitable material may be used.

As shown in FIG. 1, an entry segment support structure 30 is positioned within the entry segment cavity 23. The entry segment support structure 30 includes a hub portion 31 which is securely attached to the entry segment hub 14, and a hub portion 32 which is securely attached to the entry segment hub 15. A plurality of lateral supports 33 extend between the hub portion 31 and 32, and are securely attached to the hub portions. The lateral supports 33 are radially positioned within the entry segment cavity 23 and define an entry segment push rod cavity 34.

In the embodiment depicted in FIG. 1, the entry segment 10 utilizes a multi-tiered design which facilitates insertion into the media 2. As shown, the entry segment 10 utilizes a multi-tiered design which facilitates insertion into the ground. Moving from the tip end 11 to the attachment end 12 of the entry segment 10, the multi-tiered design is readily apparent. The first tier 26 is a smaller periphery or diameter portion of the entry segment 10, located near the tip end 11 of the entry segment 10. The periphery or diameter of the entry segment then increases at the first entry segment hub 14. The second tier 27 is a larger periphery or diameter portion of the entry segment 10, and extends from the first entry segment hub 14 to the attachment end 12 of the entry segment 10. An extension segment 40, described below in greater detail, has a third diameter and defines a third tier 28. In this multi-tiered design, the first tier 26 or smaller diameter portion of the entry segment 10 creates a "pilot hole" in the ground for the second tier 27, which is of a larger diameter, to follow. The second tier 27 is followed by the third tier 28. This multi-tiered design decreases the magnitude of force required to insert the visual probe 1 into the ground 2 (FIG. 7). After the probe tip portion 11 and the first tier 26 have advanced through the hardened soil overburden, they have provided a pathway which the rest of the visual probe 1 may follow.

FIG. 1 also shows an extension segment generally indicated by the numeral 40. The extension segment 40 includes first and second ends 41 and 42 which are open. The first end 41 is configured to be selectively coupled to the attachment end 12 of the entry segment 10 to begin forming an insertion chain 43. In the context of this document, an insertion chain 43 is defined as comprising an entry segment 10, and one or more attached extension segments 40. The extension segment 40 includes a cylindrical sidewall 44 which extends between the first and second ends 41 and 42.

In one embodiment, at least a portion of the extension segment sidewall 44 is transparent or translucent. In the embodiment shown in FIG. 1, the entire extension segment sidewall 44 is transparent. The depicted extension segment sidewall 44 is constructed of polycarbonate, however, any other suitable material may be utilized. In FIG. 1, a portion of the extension segment sidewall 44 has been removed so that the underlying structures may be more clearly shown in the drawing. Together, the cylindrical extension segment sidewall 44 and the ends 41 and 42 define in part a central cavity 45. In one embodiment, the cylindrical sidewall 44 defines an outer diameter 50 of the extension segment 10. In the illustrated embodiment, the outer diameter 50 is up to four inches; however, other diameters are used in other embodiments. In one embodiment, markings are provided along the length of the cylindrical sidewall for use in determining depth and/or orientation of subsurface objects. Alternatively, a separate ruler or rulers can be provided interior of the cylindrical sidewall for use in determining depth and orientation (relative to the direction of insertion) of subsurface objects when viewed by data capture equipment placed in the visual probe.

Referring to FIG. 1, the extension segment 40 includes an extension segment hub 51 positioned at the end 41 of the extension segment 40, and an extension segment hub 52 positioned at the end 42 of the extension segment 40. The illustrated extension segment hubs 51 and 52 are constructed of steel; however, other materials are employed in alternative embodiments. The cylindrical sidewall 44 has an open end 53 which is configured to selectively couple with the extension segment hub 51. The cylindrical sidewall 44 also has an open end 54 which is configured to selectively couple with the extension segment hub 52.

At least one extension segment hub seal 55 is positioned between the open end 53 of the cylindrical sidewall 44 and the extension segment hub 51. Similarly, at least one extension segment hub seal 56 is positioned between the open end 54 of the cylindrical sidewall 44 and the extension segment hub 52. The extension segment hub seals 55 and 56 each function as a substantial barrier to contaminants, thus impeding contaminants in the ground from entering the central cavity 45. In the embodiment depicted in FIG. 1, the extension segment hub seals 55 and 56 are each comprised of two o-rings. In one embodiment, these o-rings are constructed of fluorcarbon rubber; however, any suitable material may be used.

Still referring to FIG. 1, the extension segment 40 also includes an extension segment support structure 61 positioned within the central cavity 45. The extension segment support structure 61 provides axial and lateral support to the visual probe 1 while the visual probe 1 is inserted into the ground 2 (FIG. 7). The extension segment support structure 61 includes a hub portion 62 which is attached to the extension segment hub 51, and a hub portion 63 which is attached to the extension segment hub 52. A plurality of lateral supports 64 extend between and are attached to the hub portions 62 and 63. The lateral supports 64 are radially positioned within the central cavity 45 and define an extension segment push rod cavity 65. The radial positioning of the lateral supports 64 and large inside diameter (smallest at the hubs at about 2.5 inches), allow a camera, infrared camera or sensor, or other data retrieval equipment 120 (FIG. 11) to be lowered into the extension segment push rod cavity 65 (FIG. 1) from land's surface 3 as described below.

The extension segment hub 51 is configured to be selectively coupled to the entry segment hub 15 (of the entry segment 10) at an entry segment joint 70 (FIG. 7) as the insertion chain 43 is formed. The entry segment joint 70 includes an entry segment joint seal 71 which functions as a substantial barrier to contaminants. This entry segment joint seal 71 impedes contaminants in the ground from entering the visual probe 1. In an embodiment depicted in FIG. 1, the entry segment joint seal 71 comprises two o-rings. These o-rings may be constructed of fluorcarbon rubber; however, any suitable material may be used. Other types of seals, such as gaskets, could also be employed.

As shown in FIG. 1, the entry segment 10 and an extension segment 40 are configured to be selectively coupled to begin forming an insertion chain 43. The insertion chain 43 which is so formed may vary in length. For example, the insertion chain may include only one extension segment 40 as shown in FIG. 1, or the insertion chain 43 may instead include more than one extension segments 40 selectively coupled in series as shown in FIGS. 6, 7 and 11. In one embodiment, additional extension segments 40 are added one at a time, to lengthen the insertion chain 43 as the entry segment 10 is driven deeper into the ground 2. This may best be understood by an examination of FIG. 6, where the visual probe 1 is shown to include a plurality of the extension segments 40. Each of the extension segments 40 are configured to be selectively coupled in series to the attachment end 12 of the entry segment 10 to form the insertion chain 43 as the entry segment is driven progressively deeper into the ground 2. This may also be understood by an examination of FIG. 7, where a plurality of extension segments 40 are shown to have been selectively coupled in series to form an insertion chain 43.

As described above, each extension segment 40 has ends 41 and 42 which are open, and a cylindrical sidewall 44 at least a portion of which is transparent which extends between the ends 41 and 42. In the depicted embodiment, the entire cylindrical sidewall 44 is transparent. Together the cylindrical sidewall 44 and the ends 41 and 42 define in part a central cavity 45. The end 41 of one extension segment 40 is configured to selectively couple with the end 42 of another extension segment 40 at an extension segment joint 72 as the insertion chain 43 is formed (FIG. 7). Each extension segment joint 72 includes at least one extension segment joint seal 77 which functions as a substantial barrier to contaminants, thereby impeding contaminants in the ground from entering the visual probe 1 (FIG. 6). In the depicted embodiment, each extension segment joint seal 77 includes of two o-rings. Other types of seals, such as gaskets, could also be used. These o-rings may be constructed of fluorcarbon rubber; however, any suitable material may be used.

Referring to FIGS. 7 and 11, the insertion chain 43 which may be formed has a subsurface end 73 which is closed, and which is defined by the tip end 11 (FIG. 7) of the entry segment 10. The insertion chain 43 which may be formed also has a surface end 74 which is defined by the end 42 of the extension segment 40 which has been most recently added to the insertion chain 43. The insertion chain 43 also includes an insertion chain cavity 75 (FIG. 6, and shown in phantom lines in FIG. 7). The insertion chain cavity 75 is defined by the central cavities 45 (FIG. 6) of each of the extension segments 40 which have been coupled to form the insertion chain 43. This insertion chain cavity 75 is generally a long void which extends the length of the insertion chain 43.

Figure 2:
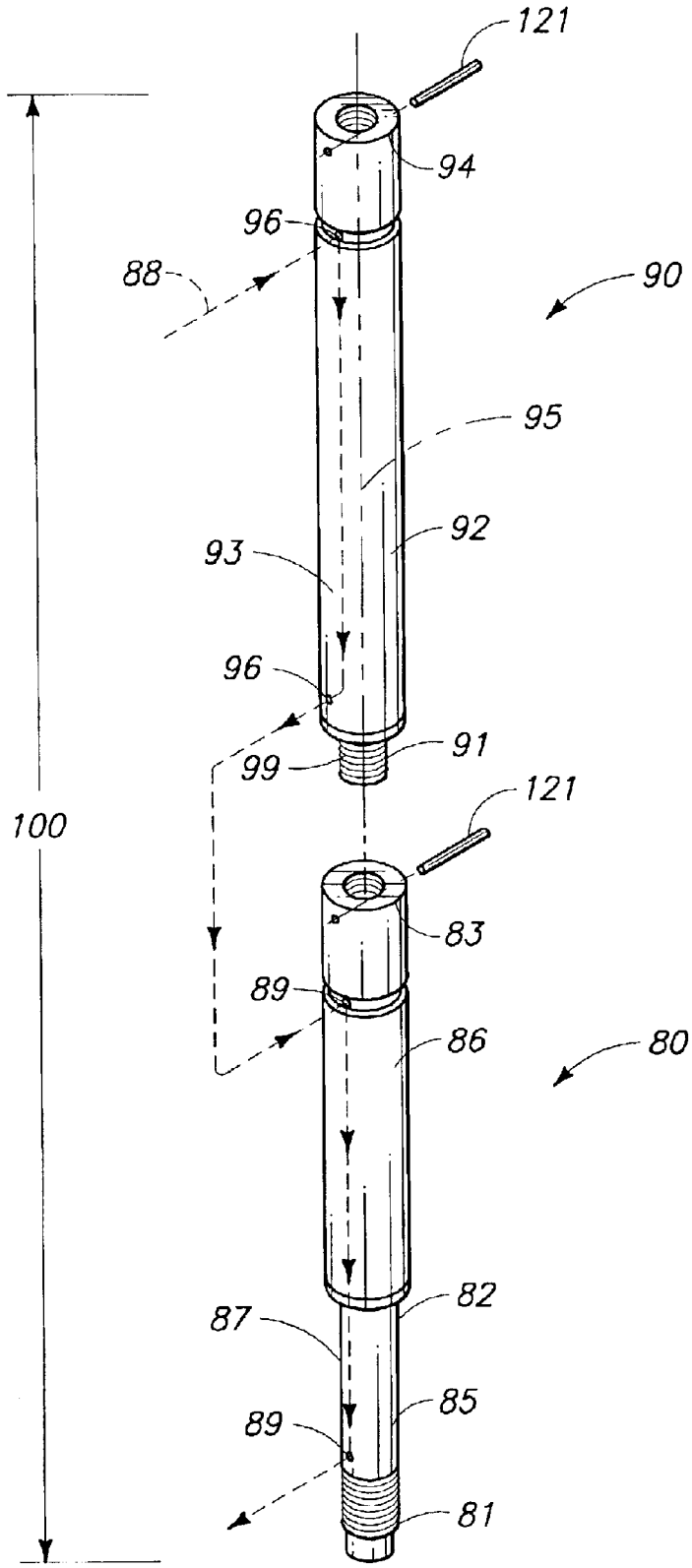
FIG. 2 is a perspective view showing an entry segment push rod and an extension segment push rod in accordance with one embodiment of the present invention.

Referring now to FIGS. 2, 5 and 6, an entry segment push rod is generally indicated by the numeral 80. The entry segment push rod 80 has a leading end 81, a push rod connection tube 82 having an outer wall 87, and a trailing end 83. In the illustrated embodiment, a gas flow path 88 is illustrated (shown in phantom lines in FIG. 2). A plurality of gas openings 89 are coupled in fluid flowing relation to the gas passageway 88, and extend through the outer wall 87 of the connection tube 82. The leading end 81 of the entry segment push rod 80 is configured to be selectively coupled to the push rod receiving point 13 of the entry segment 10 (FIGS. 1 and 6). The push rod receiving point 13 is located proximate the tip end 11 of the entry segment 10. The push rod receiving point 13 utilizes a connector such as threads, couples, sliders, solenoids, grooves, keyways or any other desired connector. In the illustrated embodiment, the connector comprises left-handed box threads configured to selectively couple with the leading end 81 of the entry segment push rod 80 so that the push rod is firmly connected to the tip 11. This ensures that cyclic load is transmitted to the tip 11. Otherwise, the vertical up and down motion caused by the sonic rig would hammer and break the push rod 80.

In one embodiment, the entry segment push rod 80 incorporates a tiered design to better distribute the driving forces as the entry segment 10 is driven into the subsurface. As shown in FIG. 2, the entry segment push rod 80 includes a lower tier 85 and an upper tier 86. The lower tier 85 is of a smaller diameter or periphery, while the upper tier 86 is of a larger diameter or periphery. In operation, the leading end 81 of the entry segment push rod 80 is selectively coupled with the push rod receiving point 13 of entry segment 10, and then the entry segment 10 and attached extension segment 40 are driven into the ground by direct push, by sonic drilling, or by a combination of direct push and sonic drilling. The entry segment push rod 80 is configured so that it may be removed after the insertion chain 43 has been driven to a desired depth, while leaving the insertion chain 43 positioned subsurface. The entry segment push rod 80 may also later be reinserted to facilitate removal of the insertion chain 43.

If the insertion chain 43 is short, and includes an entry segment 10 and only one attached extension segment 40, then only an entry segment push rod 80 will be needed to drive the insertion chain 43 subsurface. However, if the entry segment 10 is to be driven deeper subsurface, then as additional extension segments 40 are added to the insertion chain 43, additional extension segment push rods 90 will also be added, and utilized to drive the additional extension segments 40.

Referring to FIGS. 2, 5 and 6, each extension segment push rod 90 includes a first end 91, a body portion 92 having an outer wall 93, and a second end 94. Each extension segment push rod 90 has a plurality of gas openings 96 which are coupled in fluid flowing relation relative to the gas flow path 88. The gas openings 96 extend through the outer wall 93 of the body portion 92. Each extension segment push rod 90 is basically a hollow tube which is open at the first and second ends 91 and 94, and which includes a plurality of holes or gas openings 96.

In one embodiment, a plurality of extension segment push rods 90 are provided. The extension segment push rods 90 are configured to be selectively coupled in series (one at a time) to the trailing end of the entry segment push rod 80 to form a push rod string 100 as the entry segment 10 is driven progressively deeper subsurface. When multiple extension segment push rods 90 are coupled together to form the push rod string 100, gas passageways 95 of each of the extension segment push rods 90 are coupled in fluid flowing relation to form the overall gas passageway 88 (shown in phantom lines in FIG. 2). The gas passageway 88 extends along the push rod string 100, and in operation delivers a gas which is distributed throughout the insertion chain cavity 75 (FIGS. 6 and 7).

Referring to FIGS. 8–9, the push rod string 100 is configured so that, the entire push rod string 100 may be removed from the insertion chain 43, while leaving the insertion chain 43 positioned in the media 2. The push rod string 100 may then later be reinserted into the insertion chain 43 to facilitate removal of the insertion chain 43 from the media 2. After an insertion chain 43 has been retracted from the ground 2, the insertion chain 43 may be reused as appropriate. The transparent cylindrical sidewall 44 of each extension segment 40 can also be removed and replaced as required. Such may be useful if the polycarbonate used to make the cylindrical sidewall 44 becomes scratched and loses its transparency.

As described above, the leading end 81 of the entry segment push rod 80 uses left-handed threads in the illustrated embodiment, to couple to the push rod receiving point 13. Each of the extension segment push rods 90 which are coupled in series to the trailing end 83 of the entry segment push rod 80 to form the push rod string 100, are coupled using right-handed threads 99.

As shown best in FIGS. 2 and 6, after the entry segment push rod 80 and the first extension segment push rod 90 have been selectively coupled, a spring pin 121 is used to further secure the entry segment push rod 80 and the first extension segment push rod 90 together. Similarly, when multiple extension segment push rods 90 are utilized, after each additional extension segment push rod 90 has been coupled to the push rod string 100, a spring pin 121 is used to further secure each additional extension segment push rod 90 to the push rod string 100.

The depicted visual probe 1 is of adequate durability to be inserted into the ground 2 without prior excavation. The visual probe is preferably inserted into the ground 2 by direct push, by sonic drilling, or by a combination of direct push and sonic drilling. Furthermore, the visual probe 1 of the illustrated embodiment is of adequate durability to be inserted into the ground 2 to a desired depth (FIG. 7). Coupling the leading end 81 of the entry segment push rod 80 to the tip end 11 of the entry segment 10 helps prevent the entry segment push rod 80 from impacting the tip end 11 while the visual probe is inserted into the ground 2.

Figure 3:
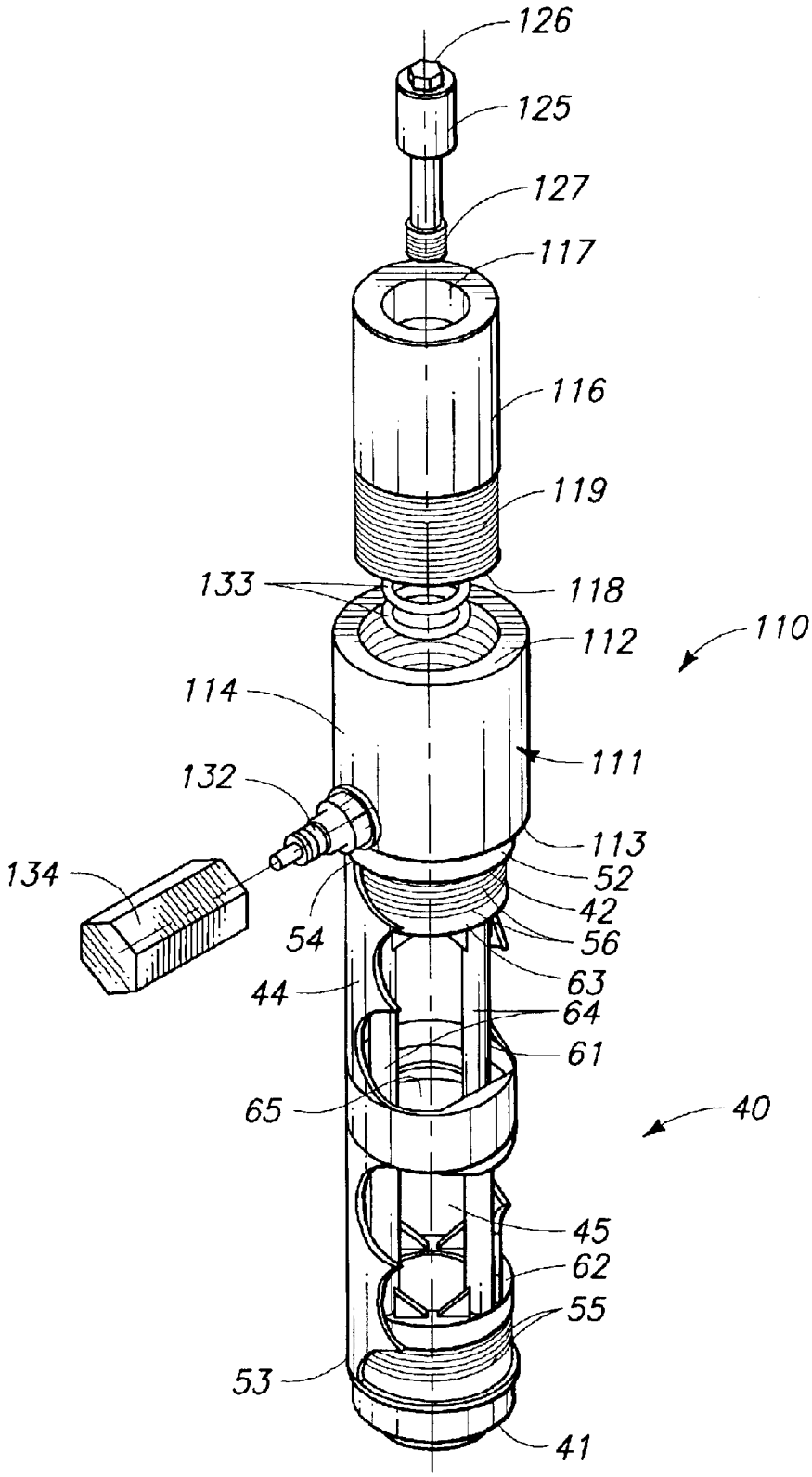
FIG. 3 is a perspective view showing a pressure cap and an extension segment in accordance with one embodiment of the present invention.
Figure 4:
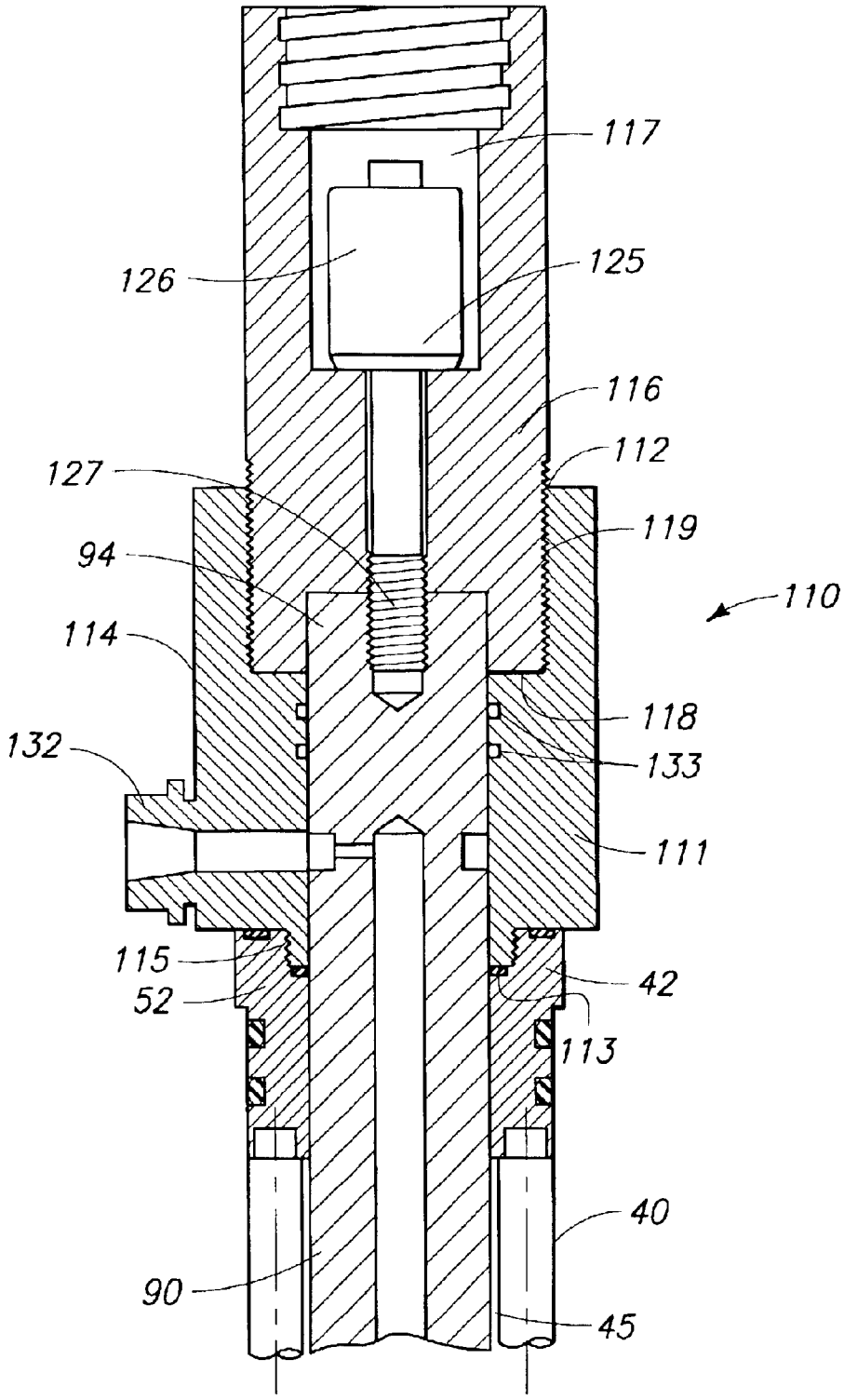
FIG. 4 is a partial sectional view showing the pressure cap and part of the extension segment of FIG. 3.

Referring to FIGS. 3–7, a pressure cap is generally indicated by the numeral 110. The pressure cap includes a pressure cap base 111. The pressure cap base 111 includes (see FIG. 3) an open top surface 112, an open bottom surface 113, and a cap sidewall 114. The open bottom surface 113 of the pressure cap 111 is configured to selectively couple with the second end 42 of an extension segment 40 which has been most recently added to the insertion chain 43, at pressure cap joint 115 (FIG. 4). In the illustrated embodiment, the open bottom surface 113 of the pressure cap base 111 threads down and sits against o-rings flush against the second extension segment hub 52 (FIGS. 3, 4 and 6); other embodiments are possible.

As shown in FIGS. 3, 4 and 6, the pressure cap 110 also includes a cap top 116. The cap top 116 includes an open top end 117 and open bottom end 118. The open bottom end 118 of the cap top 116 is configured to be selectively coupled with the open top surface 112 of the pressure cap base 111. In one embodiment, the cap top 116 includes threaded couplings 119 which allow the operator to adjust for variations in the length of the insertion chain 43. The pressure cap 110 also includes a bolt 125 having an upper end 126 and a lower threaded end 127. The bolt 125 is received by the open top end 117 of the pressure cap top 116, and selectively couples with the second end 94 of the extension segment push rod 90 which was last added to the push rod string 100. A pressure cap seal 133 is positioned between the pressure cap base 111 and the extension segment push rod 90 (FIGS. 3, 4 and 6).

The pressure cap seal 133 functions as a substantial barrier to contaminants. In the event that contaminants from the ground 2 enter the insertion chain cavity 75, the pressure cap 110 and pressure cap seal 133 help impede the movement of such contaminants, so that such contaminants will not escape to the land's surface 2. In the depicted embodiment, the pressure cap seal 133 is comprised of two o-rings. In the illustrated embodiment, these o-rings are preferably constructed of fluorcarbon rubber; however, any suitable material may be used.

The pressure cap top 116 is configured to interface with the drill rig's 130 push shoe 131 (FIG. 7). The pressure cap 110 also includes a selectively operable valve 132 which is located on the sidewall 114 of the pressure cap base 111. A valve cover 134 is configured to cover the selectively operable valve 132.

The pressure cap 110 allows the central cavity 45 to be substantially sealed before the extension segment 40 and attached entry segment 10 are initially driven into the ground. The pressure cap 110 also allows the integrity of the insertion chain cavity 75 to be tested as each additional extension segment 40 is added to the insertion chain 43. As described above, the pressure cap 110 is not only configured to selectively couple with the second end 42 of an extension segment 40 which has been most recently added to the insertion chain 43, but it is also configured to selectively couple with the second end 94 of the extension segment push rod 90 which has been most recently added to the push rod string 100 (FIGS. 2–5). The pressure cap 110 allows the insertion chamber cavity 75 to be substantially sealed before the most recently added extension segment 40 is driven into the ground. In any field where there are toxic or nuclear materials, it is desirable to ensure that such materials will not come to the surface. Therefore, pressure testing is performed to ensure that the probe is not breached.

The methods and operation of the present invention are now further described with reference to FIGS. 1–11. One method for placing a visual probe into a subsurface area 2 includes providing an entry segment 10 configured to be driven into the ground 2, providing a first extension segment 40, and then selectively coupling a first end 41 of a first extension segment 40 with the attachment end 12 of the entry segment 10 to begin forming an insertion chain 43. An entry segment push rod 80 is also provided. The leading end 81 of the entry segment push rod 80 is selectively coupled with the push rod receiving point 13 to begin forming a push rod string 100. After selectively coupling the leading end 81 of the entry segment push rod 80 to the push rod receiving point 13, and after selectively coupling a first end 41 of the first extension segment 40 with the attachment end 12 of the entry segment 10, a pressure cap 110 is provided (FIGS. 3–4). The pressure cap 110 is selectively coupled to the second end 42 of the extension segment 40, and is also selectively coupled to the trailing end 83 of the entry segment push rod 80 to substantially seal the central cavity 45. In this way, the central cavity 45 is substantially sealed by the pressure cap 110, before and during advancement of the visual probe 1 into the ground 2, thereby providing no open pathway for fugitive emissions to travel from the ground or subsurface areas 2 to land's surface 3. After substantially sealing the central cavity 45 with the pressure cap 110, at least a portion of the entry segment 10 and the first extension segment 40 are driven into the ground 2. This may be accomplished by direct push, by sonic drilling, or by a combination of direct push and sonic drilling.

According to one method, a gas is added to the central cavity 45 using the selectively operable valve 132 (FIG. 5), so that the central cavity 45 (FIG. 1) is under a pressure, before the entry segment 10 and the first extension segment 40 are driven into the ground. According to one method, the central cavity is substantially sealed with the pressure cap 110 before the entry segment 10 and the first extension segment 40 are driven into the ground, then a gas is added to the central cavity 45 using the selectively operable valve 132, so that the central cavity 45 is under a pressure, to make sure that no breach of containment has occurred. Pressure is released before driving segments 10 and 40 into the ground. After the entry segment 10 and the first extension segment 40 have been driven into the ground 2, the integrity of the visual probe 1 may again be evaluated by testing the ability of the central cavity 45 to maintain a pressure.

After the integrity of the visual probe 1 has been proved (i.e. the central cavity 45 is able to maintain a pressure to make sure there is no breach of containment), the pressure cap 110 may be removed. At this point, the push rod string 100 may be extracted from the insertion chain 43, so that the data acquisition equipment 120 (FIG. 11) may be placed into the central cavity 45 (FIG. 1) so that objects in the ground 2 may be viewed through the transparent portions of the extension segment sidewall 44.

Furthermore, after the integrity of the visual probe 1 has been proved, it is also possible to remove the pressure cap 110 so that an additional extension segment 40 may be added to lengthen the insertion chain 43, and so that an extension segment push rod 80 may be added to the push rod string 100, thereby allowing the visual probe 1 to be driven deeper into the ground 2.

In order to drive the visual probe 1 incrementally deeper into the ground 2, additional extension segments 40 are sequentially added (preferably one at a time) to the insertion chain 43. As each additional extension segment 40 is added, an additional extension segment push rod 90 is also added to the push rod string 100. Therefore, one method includes providing a plurality of extension segments 40 which are configured to be sequentially selectively coupled in series to the entry segment 10, to form an insertion chain 43 as the entry segment 10 is driven progressively deeper into the ground. These additional extension segments 40 may be selectively coupled in series to the first extension segment 40 to lengthen the insertion chain 43 as the entry segment 10 is driven progressively deeper into the ground 2. In the depicted embodiment, the entry segment 10 may be driven into the ground 2 to a desired depth. Depths of over 50 feet, for example, are possible. The central cavities 45 of each of the respective extension segments 40 which have been selectively coupled to form the insertion chain 43 together define an insertion chain cavity 75 (shown in phantom lines in FIG. 7). The insertion chain cavity 75 has an upper end or surface end 74 which is open to land's surface, and a lower end or subsurface end 73 which is closed.

After each individual extension segment 40 is respectively added to the insertion chain 43, the insertion chain cavity 75 is sealed with the pressure cap 110 and pressure tested, before the insertion chain 43, which now includes the additional extension segment 40, is driven into the ground 2. Therefore, the integrity of the insertion chain cavity 75 and the integrity of the seals are proved with each extension segment 40 which is driven into the ground 2. Before selectively coupling each additional extension segment 40 to lengthen the insertion chain 43, one method includes pressurizing the insertion chain cavity 75 by adding a gas into the insertion chain cavity 75 using the selectively operable valve 132 so that the insertion chain cavity 75 is under a pressure, and then evaluating the integrity of the insertion chain cavity 75 by testing the ability of the insertion chain cavity 75 to maintain the pressure.

As described above, in order to drive the visual probe 1 deeper into the ground 2, additional extension segment push rods 90 are sequentially added (preferably one at a time) to the push rod string 100 which is used to drive the visual probe 1 into the ground 2. One method includes providing a plurality of extension segment push rods 90 which are configured to be sequentially selectively coupled to the trailing end 83 of the entry segment push rod 80 to form a push rod string 100 as the entry segment 10 is driven deeper into the ground 2.

When more than one extension segment push rod 90 is selectively coupled to form a push rod string 100, the gas passageways of each of the extension segment push rods 90 are coupled in fluid flowing relation to form in part an overall gas passageway 88 (shown in phantom lines in FIG. 2) which extends along the push rod string 100, and which in operation delivers a gas which is distributed throughout the insertion chain cavity 75 (FIGS. 6 and 7). The entry segment push rod 80 also includes a gas passageway which forms part of the overall gas passageway 88.

Referring to FIG. 5, a source of pressurized gas (not shown) may be attached to the selectively operable valve 132. When the valve 132 is opened, the pressurized gas will flow through the selectively operable valve 132 and into the gas passageway of the most recently added extension segment push rod 90. The gas passageway of the extension segment push rod 90 and the gas passageway of the entry segment push rod 80 are coupled in fluid flowing relation to form the overall gas passageway 88 (FIG. 2). The gas flows through the overall gas passageway 88 and is distributed along the entire push rod string 100 (as shown by phantom lines and arrows in FIG. 2). If additional extension segment push rods 90 have been added to the push rod string 100, these will also be coupled in fluid flowing relation to form part of the overall gas passageway 88. As depicted in FIG. 2, the gas flows through the overall gas passageway 88 and flows out of the plurality of gas openings 96 and 89. Thus, gas pressure is distributed substantially evenly throughout the entire insertion chain cavity 75.

The entry segment push rod 80 and the one or more extension segment push rods 90 which have been selectively coupled to form the push rod string 100 are formed of a composite or metal, such as steel, in the illustrated embodiment; however, other materials are employed in alternative embodiments. In addition to distributing gas to the insertion chain cavity 75, the push rod string 110 also functions to drive the insertion chain 43 into the ground. A framework 30, 61 protects tubing from large compressive or tensive loads because the framework is longer than the clear tubes 44. Axial loads are not placed on the tubes 44 but instead are placed on the framework. In the illustrated embodiment, the framework includes round bar which can easily be seen around by a camera 120, if a camera is the type of equipment used for data collection. The entry segment support structure 30 (FIG. 6) and the extension segment support structures 61 provide lateral support to the push rods string 100 (and substantially reduce the buckling risk that arises with any large column). A perimeter clearance exists between the outer surface of the push rod string 100 and the cylindrical sidewalls 44 of the extension segments 40. This helps to prevent the push rod string 100 from engaging or applying force to the cylindrical sidewalls 44 of the extension segments 40 instead of to the framework.

In one method, after a portion of the entry segment 10 and the first extension segment 40 have been driven into the ground 2, the integrity of the visual probe 1 is evaluated by testing the ability of the central cavity 45 to maintain the pressure. One method includes evaluating the integrity of the visual probe 1 by testing the ability of the central cavity 45 to maintain the pressure before each additional extension segment 40 is added to the insertion chain 43. The method may also include evaluating the integrity of the visual probe 1 by testing the ability of the central cavity 45 to maintain the pressure after driving each additional extension segment 40 into the ground 2. The method may also include evaluating the integrity of the insertion chain cavity 75 by testing the ability of the insertion chain cavity to maintain a pressure. In one method, after the additional extension segments 40 have been added to the insertion chain 43, and after additional extension segment push rods 90 have been added to the push rod string 100, and after the entry segment 10 has been driven to a selected depth, the integrity of the insertion chain 43 is evaluated by testing the ability of the insertion chain cavity 43 to maintain a pressure. In the context of this document, the term "selected depth" means a depth within the media 2 in which the visual probe 1 is to be placed. The selected depth may be chosen prior to placement of the visual probe 1 into the ground, or the selected depth may be chosen during placement of the visual probe 1. After the integrity of the insertion chain cavity 43 has be confirmed, the pressure cap 110 may be removed from the second end 42 of the last extension segment 40 which was added to the insertion chain 43.

Referring to FIGS. 1–9, after removing the pressure cap 110 the push rod string 100 may be removed from the insertion chain 43. To remove the push rod string 100 from the insertion chain 43, the push rod string 100 is first rotated in a clockwise fashion so that the leading end 81 of the entry segment push rod 80 will be un-threaded from the push rod receiving point 13 of the entry segment 10.

FIGS. 8 and 9 show a portion of the visual probe 1 positioned within the media 2. After the pressure cap 110 has been removed, a retractor 97 is secured to the second end 94 of the last extension push rod 90 which was added to the push rod string 100. The retractor 97 is then used to extract the push rod string 100 from the visual probe 1. FIG. 8 show the retractor 97 as it initially begins extracting the push rod string 100 from the visual probe 1, while FIG. 9 shows the retractor 97 as the push rod string 100 is further extracted from the visual probe 1.

As shown best in FIG. 11, after the pressure cap 110 and the push rod string 100 have been removed from the visual probe 1, a camera or other data retrieval equipment 120 may be lowered or placed into the insertion chain cavity 75 so that objects 150 (e.g., buried waste containers, waste materials, sludges, or other objects) in the ground 2 adjacent to the insertion chain 43 may be viewed through the transparent portions of the sidewalls 44 (or through the completely transparent sidewalls) of the extension segments 40 which make up the insertion chain 43. The data retrieval equipment 120 may be lowered or moved along the entire length of the insertion chain 43 to view the subsurface 2 at a variety of depths and may be rotated. The data retrieval equipment 120 may be lowered into the insertion chain cavity 75 using a connector 122; however, any suitable device may be used to lower the data retrieval equipment 120 into the insertion chain cavity 75.

Referring to FIG. 10, after removing the pressure cap 110, a field cap 140 may be selectively coupled to the upper end or surface end 74 of the insertion chain 43, substantially sealing the insertion chain cavity 75 while the visual probe 1 is not in use. The field cap 140 includes a ball valve 141 and tubing 142 that terminates with a quick-disconnect body (not shown). The ball valve 141 and tubing 142 are housed in a weatherproof box 143 which has a door 144. The field cap hub 145 selectively couples to the surface end 74 of the insertion chain 43. At least one extension segment joint seal 77 substantially seals the field cap hub 145 to the surface end 74 of the insertion chain 43, forming a substantial barrier to contaminants. In the depicted embodiment, the extension segment joint seal 77 comprises a pair of o-rings. These o-rings are constructed of fluorcarbon rubber, however, any suitable material may be used.

When the visual probe 1 is not in use, the field cap 140 may be selectively coupled to the upper end or surface end 74 of the insertion chain 43, substantially sealing the insertion chain cavity 75 for extended periods of time. The field cap 140 may then later be removed so that the visual probe 1 may again be used to visualize the subsurface areas 2.

Before the field cap 140 is removed, and the visual probe 1 used, the integrity of the insertion chain cavity 75 is again tested, by evaluating the ability of the insertion chain cavity 75 to maintain a pressure. This procedure in effect tests the integrity of each of the seals which make up the insertion chain, including: the entry segment joint seal 71, the first and second entry segment hub seals 24 and 25, the extension segment joint seal 77 at each extension segment joint 72, the first and second extension segment hub seals 55 and 56 of each extension segment 40, and the extension segment joint seal 77 at the field cap hub 145. If the insertion chain cavity 75 cannot maintain a pressure, due to a failure of any of the seals or for any other reason, the field cap 140 may be left in place to substantially seal the surface end 74 of the insertion chain cavity 75, impeding the escape of fugitive gases or other contaminants to land's surface 3.

Thus, a visual probe has been disclosed that can be used in contaminated and difficult areas as well as non-contaminated areas. The visual probe can be placed in hardened soil and through difficult materials (e.g., where hardened debris, concrete, asphalt, metals, etc. are included in the soil or ground environment) without prior excavation or drilling. The visual probe is structurally designed and engineered to withstand large force magnitudes associated with ground placement. Commercial probes of similar function are typically very fragile and normally require prior excavation. The visual probe's multiple-tiered entry stage provides for a pilot hole effect for trailing sections and greatly reduces force magnitudes required for probe installation. The visual probe provides for full viewing through its clear casing along most of its entire probe string length and perimeter. The internal structure does not hinder viewing and allows substantially for 100% circular perimeter viewing. The internal framework of the visual probe increases the casing's interior cavity volume and inner cavity diameter, allowing access for a camera and/or geophysical equipment placement. The internal framework not only provides structural stability to the probe and push rod, but also allows the probe's inner cavity to be much larger than conventional probes, which allows other geophysical instruments to be used within it, in addition to a camera. The visual probe supports the use of dual (redundant) seals that form a ground barrier and impede the spread of contamination to ground surface. The visual probe's pressure cap allows the probe casing to be pressure tested at any depth interval, to verify probe structural and seal integrity. This allows quality assurance tests to be performed on the probe to determine its functionality while it is installed into the ground. The visual probe is designed and engineered for longevity and allows for repetitive use, after ground insertion. The visual probe can be used repeatedly while it is in the ground. The visual probe is designed for ground retraction and reuse. The clear tube casing can be replaced as required and the probe can be relocated and reused. This makes this a cost efficient tool. Many conventional probes are left in the ground because retrieval would typically be too costly or result in damage.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A visual probe for viewing subsurface areas, comprising:

an entry segment having a tip end configured for insertion into a ground, an attachment end, and a push rod receiving point;

an extension segment having first and second ends which are open, the first end configured to be selectively coupled to the attachment end of the entry segment at an entry segment joint to form an insertion chain, and a cylindrical sidewall at least a portion of which is transparent which extends between the first and second ends, the cylindrical sidewall and the first and second ends together defining in part a central cavity;

an entry segment push rod having a leading end, a push rod connection tube, and a trailing end, the leading end being configured to be selectively coupled to the push rod receiving point of the entry segment;

a pressure cap having a selectively operable valve, the pressure cap being configured to selectively couple with the second end of the extension segment, and the pressure cap selectively substantially sealing the central cavity before the extension segment and attached entry segment are driven into the ground.

2. A visual probe in accordance with claim 1 and further comprising a field cap configured to selectively couple with the second end of the extension segment to selectively substantially seal the central cavity, wherein the field cap includes a selectively operable valve for use in pressurizing the central cavity, and also for use in releasing pressure from the central cavity.

3. A visual probe in accordance with claim 1 wherein the entry segment includes multiple tiers which facilitate insertion into the ground.

4. A visual probe in accordance with claim 1 having a first portion having a first diameter, a second portion having a second diameter, and a third portion having a third diameter, the second diameter being larger than the first diameter, and the third diameter being larger than the second diameter.

5. A visual probe in accordance with claim 1 wherein all of the cylindrical sidewall is transparent.

6. A visual probe in accordance with claim 1 wherein the entry segment push rod is configured so that it may be removed after the insertion chain has been driven to a desired depth in the ground.

7. A visual probe in accordance with claim 1 wherein the entry segment push rod is configured so that it may be removed once the insertion chain has been driven to a desired depth in the ground, while leaving the insertion chain positioned within the ground, and wherein the entry segment push rod may later be reinserted to facilitate removal of the insertion chain from the ground.

8. A visual probe in accordance with claim 1 wherein the visual probe includes a framework comprising a plurality of spaced apart rods, whereby the probe is visually able to withstand large loads and to be inserted into the ground without prior excavation.

9. A visual probe in accordance with claim 1 wherein the visual probe includes a framework comprising a plurality of spaced apart rods, wherein the framework and push rod absorb installation loads and protect the cylindrical sidewall from such loads.

10. A visual probe in accordance with claim 1 wherein the visual probe includes a framework comprising a plurality of spaced apart rods in load bearing relation to the push rod, whereby the visual probe is of adequate durability to be inserted into the ground by direct push.

11. A visual probe in accordance with claim 1 wherein the visual probe includes a framework comprising a plurality of spaced apart members in load bearing relation to the push rod, whereby the visual probe is of adequate durability to be inserted into the ground by sonic drilling.

12. A visual probe in accordance with claim 1 wherein the visual probe includes a framework comprising a plurality of spaced apart longitudinally extending members in load bearing relation to the push rod, whereby the visual probe is of adequate durability to be inserted into the ground by a combination of direct push and sonic drilling.

13. A visual probe in accordance with claim 1 wherein the cylindrical sidewall of the extension segment has an inner diameter of at least two inches.

14. A visual probe in accordance with claim 1 wherein the push rod receiving point is located proximate the tip end of the entry segment, and wherein the push rod receiving point has left-handed threads configured to selectively couple with the leading end of the entry segment push rod.

15. A visual probe in accordance with claim 1 wherein the entry segment further comprises a first entry segment hub positioned proximate the tip end of the entry segment; a second entry segment hub positioned at the attachment end of the entry segment; an entry segment sidewall having open first and second ends and extending between the first and second entry segment hubs, the open first end of the entry segment sidewall being configured to selectively couple with the first hub, the open second end of the entry segment sidewall being configured to selectively couple with the second hub, the entry segment sidewall and the open first and second ends defining in part an entry segment cavity; and an entry segment support structure positioned within the entry segment cavity.

16. A visual probe in accordance with claim 15, wherein the entry segment further comprises a first entry segment hub seal positioned between the open first end of the entry segment sidewall and the first entry segment hub; and a second entry segment hub seal positioned between the open second end of the entry segment sidewall and the second entry segment hub.

17. A visual probe in accordance with claim 15 wherein the entry segment support structure comprises a first hub portion attached to the first entry segment hub; a second hub portion attached to the second entry segment hub; and a plurality of lateral supports extending between the first and second hub portion, wherein the plurality of lateral supports are radially positioned within the entry segment cavity and define an entry segment push rod cavity.

18. A visual probe in accordance with claim 1 wherein the extension segment further comprises a first extension segment hub positioned at the first end of the extension segment; a second extension segment hub positioned at the second end of the extension segment, wherein the cylindrical sidewall has a first open end which is configured to selectively couple with the first extension hub, and a second open end which is configured to selectively couple with the second extension hub; and an extension segment support structure positioned within the central cavity.

19. A visual probe in accordance with claim 18 wherein the extension segment further comprises a first extension segment hub seal positioned between the open first end of the cylindrical sidewall and the first extension segment hub; and a second extension segment hub seal positioned between the open second end of the cylindrical sidewall and the second extension segment hub.

20. A visual probe in accordance with claim 18 wherein the extension segment support structure comprises a first hub portion attached to the first extension segment hub; a second hub portion attached to the second extension segment hub; and a plurality of lateral supports extending between the first and second hub portions, wherein the plurality of lateral supports are radially positioned within the central cavity and define an extension segment push rod cavity.

21. A visual probe in accordance with claim 18 wherein the first extension segment hub is configured to be selectively coupled to the second entry segment hub at an entry segment joint as the insertion chain is formed, and wherein the entry segment joint includes an entry segment joint seal.

22. A visual probe in accordance with claim 1 wherein the entry segment joint includes a plurality of entry segment joint seals.

23. A visual probe for viewing subsurface areas, comprising:

an entry segment having a tip end configured for insertion into a ground, an attachment end, and a push rod receiving point;

a plurality of extension segments which are configured to be selectively coupled in series to the attachment end of the entry segment to form an insertion chain as the entry segment is driven progressively deeper into the ground; each extension segment having first and second ends which are open and a cylindrical sidewall, at least a portion of which is transparent, which extends between the first and second ends, the cylindrical sidewall and the first and second ends together defining in part a central cavity; the first end of one extension segment being configured to selectively couple with the second end of another extension segment at an extension segment joint as the insertion chain is formed, the insertion chain including a subsurface end which is defined by the tip end of the attached entry segment and a surface end which is defined by the second end of an extension segment which has been most recently added to the insertion chain, and including an insertion chain cavity which is defined by the central cavities of the plurality of extension segments which have been selectively coupled to form the insertion chain;

an entry segment push rod having a leading end, a push rod connection tube, and a trailing end, the leading end being configured to be selectively coupled to the push rod receiving point of the entry segment;

a plurality of extension segment push rods configured to be selectively coupled in series to the trailing end of the entry segment push rod to form a push rod string as the entry segment is driven progressively deeper into the ground, each extension segment push rod including a first end, a body portion having an outer wall, a second end; and a pressure cap having a selectively operable valve, the pressure cap being configured to selectively couple with the second end of an extension segment which has been most recently added to the insertion chain, and the pressure cap being configured to selectively couple with the second end of extension segment push rod which has been most recently added to the push rod string, and the pressure cap selectively closing the insertion chain cavity for selective pressure testing to reduce risk of contaminants reaching ground surface though the visual probe.

24. A visual probe in accordance with claim 23 wherein, as each of the extension segment push rods are selectively coupled to form the push rod string, the gas passageways of each of the extension segment push rods are coupled in fluid flowing relation to form an overall gas passageway which extends at least along the push rod string.

25. A visual probe in accordance with claim 23 and further comprising a field cap configured to substantially seal the surface end of the insertion chain, wherein the field cap includes a selectively operable valve for use in pressurizing the insertion chain cavity, and also for use in releasing pressure from the insertion chain cavity.

26. A visual probe in accordance with claim 23 wherein the entry segment has multiple tiers to facilitate insertion into the ground.

27. A visual probe in accordance with claim 23 wherein the entry segment push rod is tiered.

28. A visual probe in accordance with claim 23 wherein the cylindrical sidewall of each of the extension segments is transparent.

29. A visual probe in accordance with claim 23 wherein the cylindrical sidewall of each of the extension segments have an inner diameter of at least 2 inches.

30. A visual probe in accordance with claim 23 wherein the push rod string is configured so that it may be removed after the insertion chain has been driven to a desired depth in the ground, while leaving the insertion chain positioned within the ground.

31. A visual probe in accordance with claim 23 wherein the push rod string is configured so that it may be removed after the insertion chain has been driven to a desired depth in the ground, while leaving the insertion chain positioned within the ground, and wherein the push rod string may later be reinserted to facilitate removal of the insertion chain from the ground.

32. A visual probe in accordance with claim 23 wherein the pressure cap is configured to selectively couple with the second end of an extension segment which has been most recently added to the insertion chain, to substantially seal the insertion chain cavity, thereby allowing the integrity of the insertion chain cavity to be selectively tested as each extension segment is added to the insertion chain.

33. A visual probe in accordance with claim 23 wherein the visual probe includes a framework comprising a plurality of spaced apart rods, wherein the framework and push rod absorb installation loads and protect the cylindrical sidewall from such loads.

34. A visual probe in accordance with claim 23 wherein the visual probe includes a framework comprising a plurality of spaced apart rods in load bearing relation to the push rod, whereby the visual probe is of adequate durability to be inserted into the ground by direct push.

35. A visual probe in accordance with claim 23 wherein the visual probe includes a framework comprising a plurality of spaced apart members in load bearing relation to the push rod, whereby the visual probe is sufficiently robust to be inserted into the ground by sonic drilling.

36. A visual probe in accordance with claim 23 wherein the visual probe includes a framework comprising a plurality of spaced apart longitudinally extending members in load bearing relation to the push rod, whereby the visual probe is sufficiently robust to be inserted into the ground by a combination of direct push and sonic drilling.

37. A visual probe in accordance with claim 23 wherein the push rod receiving point is located proximate the tip end of the entry segment.

38. A visual probe in accordance with claim 23 wherein the push rod receiving point has means for selectively coupling with the leading end of the entry segment push rod.

39. A visual probe in accordance with claim 37 wherein the push rod receiving point has left-handed threads configured to selectively couple with the leading end of the entry segment push rod.

40. A visual probe in accordance with claim 23 wherein the plurality of extension segment push rods which are configured to be selectively coupled in series to the trailing end of the entry segment push rod to form a push rod string as the entry segment is driven progressively deeper into the ground are selectively coupled using means for coupling.

41. A visual probe in accordance with claim 38 wherein the plurality of extension segment push rods which are configured to be selectively coupled in series to the trailing end of the entry segment push rod to form a push rod string as the entry segment is driven progressively deeper into the ground are selectively coupled using means for coupling.

42. A visual probe in accordance with claim 23 wherein the entry segment further comprises a first entry segment hub positioned proximate the tip end of the entry segment; a second entry segment hub positioned at the attachment end of the entry segment, an entry segment sidewall having open first and second ends and extending between the first and second entry segment hubs, wherein the open first end of the entry segment sidewall configured to selectively couple with the first hub, wherein the open second end of the entry segment sidewall configured to selectively couple with the second hub, and wherein the entry segment sidewall and the open first and second ends define in part an entry segment cavity; and an entry segment support structure positioned within the entry segment cavity.

43. A visual probe in accordance with claim 42 wherein the entry segment further comprises a first entry segment hub seal positioned between the open first end of the entry segment sidewall and the first entry segment hub; and a second entry segment hub seal positioned between the open second end of the entry segment sidewall and the second entry segment hub.

44. A visual probe in accordance with claim 42 wherein the entry segment support structure comprises a first hub portion attached to the first entry segment hub; a second hub portion attached to the second entry segment hub; and a plurality of lateral supports extending between the first and second hub portions, wherein the plurality of lateral supports are radially positioned within the entry segment cavity and define an entry segment push rod cavity.

45. A visual probe in accordance with claim 23 wherein each extension segment further comprises a first extension segment hub positioned at the first end of the extension segment; a second extension segment hub positioned at the second end of the extension segment, wherein the cylindrical sidewall has a first open end which is configured to selectively couple with the first extension hub and a second open end which is configured to selectively couple with the second extension hub; and an extension segment support structure positioned within the central cavity.

46. A visual probe in accordance with claim 45 wherein the extension segment further comprises a first extension segment hub seal positioned between the open first end of the cylindrical sidewall and the first extension segment hub; and a second extension segment hub seal positioned between the open second end of the cylindrical sidewall and the second extension segment hub.

47. A visual probe in accordance with claim 45 wherein the extension segment support structure comprises a first hub portion attached to the first extension segment hub; a second hub portion attached to the second extension segment hub; and a plurality of supports extending between the first and second hub portions, wherein the plurality of supports are radially positioned within the central cavity and define an extension segment push rod cavity, and wherein the radial positioning of the supports allows data retrieval equipment to be lowered into the extension segment push rod cavity.

48. A visual probe in accordance with claim 47 wherein the supports protect the cylindrical sidewall from insertion loads by absorbing insertion loads.

49. A visual probe in accordance with claim 42 wherein the extension segment support structure comprises a first hub portion; a second hub portion attached to the second extension segment hub; and a plurality of supports extending between the first and second hub portions, wherein the plurality of supports are radially positioned within the central cavity and define an extension segment push rod cavity, and wherein the supports absorb loads along the direction of insertion of the visual probe and thereby protect the cylindrical sidewall from loads in the direction of insertion of the visual probe.

50. A visual probe in accordance with claim 42 wherein the extension segment support structure comprises a first hub portion; a second hub portion attached to the second extension segment hub; and a plurality of rods extending between the first and second hub portions, wherein the plurality of rods are radially positioned within the central cavity and define an extension segment push rod cavity, wherein the radial positioning of the lateral supports allows visual data capture equipment to be lowered into the extension segment push rod cavity, and wherein the rods are cylindrical, whereby blocking of the view of the visual data capture equipment by the rods is less than if another shape was used.

51. A visual probe in accordance with claim 42 wherein the extension segment support structure comprises a first hub portion; a second hub portion attached to the second extension segment hub; and a plurality of rods extending between the first and second hub portions, wherein the plurality of rods are radially positioned within the central cavity and define an extension segment push rod cavity, wherein the radial positioning of the lateral supports allows visual data capture equipment to be lowered into the extension segment push rod cavity, and wherein 360 degree rotation of the visual data capture equipment, relative to the direction of insertion of the visual probe, is possible.

52. A visual probe in accordance with claim 45 wherein a first extension segment hub is configured to be selectively coupled to the second entry segment hub at an entry segment joint as the insertion chain is formed, and wherein the entry segment joint includes an entry segment joint seal.

53. A visual probe in accordance with claim 45 wherein the first extension segment hub of one extension segment is configured to selectively couple with the second extension segment hub of another extension segment at an extension segment joint as the insertion chain is formed, and wherein the extension segment joint includes at least one extension segment joint seal.

54. A visual probe for gathering data from subsurface areas, comprising:

an entry segment having a tip end configured for insertion into the ground and an attachment end;

a plurality of extension segments which are configured to be selectively coupled in series to the attachment end of the entry segment to form an insertion chain as the entry segment is driven progressively deeper into the ground; each extension segment having first and second ends which are open and a transparent cylindrical sidewall which extends between the first and second ends, the transparent cylindrical sidewall and the first and second ends together defining in part a central cavity; the first end of one extension segment being configured to selectively couple with the second end of another extension segment at an extension segment joint as the insertion chain is formed, the insertion chain having an insertion chain cavity which is defined by the central cavities of each of the extension segments which have been selectively coupled to form the insertion chain;

a push rod receiving point positioned on the entry segment; an entry segment push rod having a leading end, a push rod connection tube, and a trailing end, wherein the leading end is configured to be selectively coupled to the push rod receiving point of the entry segment; and a plurality of extension segment push rods which are configured to be selectively coupled in series to the trailing end of the entry segment push rod to form a push rod string as the entry segment is driven progressively deeper into the ground, wherein each extension push rod includes a first end, a body portion having an outer wall, a second end, a gas passageway, and a plurality of gas openings which are coupled in fluid flowing relation to the gas passageway, and which extend through the outer wall of the body portion; and a pressure cap configured to selectively couple with the second end of an extension segment which has been most recently added to the insertion chain, whereby the pressure cap substantially seals the insertion chain cavity before the most recently added extension segment is driven into the ground and selectively used to drive the visual probe into the ground.

55. A method for placing a visual probe into a subsurface area, comprising:

providing an entry segment configured to be driven into a ground, the entry segment having a tip end and an attachment end;

providing a plurality of extension segments configured to selectively couple in series to the entry segment to form an insertion chain as the entry segment is driven progressively deeper into the ground, each extension segment having a cylindrical sidewall defining in part a central cavity, at least a portion of each cylindrical sidewall being transparent;

selectively coupling a first extension segment to the attachment end of the entry segment to begin forming the insertion chain;

after selectively coupling a first extension segment to the attachment end of the entry segment, driving at least a portion of the entry segment and the first extension segment into the ground; and selectively coupling additional extension segments to the first extension segment to lengthen the insertion chain as the entry segment is driven to a selected depth in the ground, the central cavities of each of the extension segments which have been selectively coupled to form the insertion chain together defining an insertion chain cavity, the insertion chain cavity having an upper end which is open to ground's surface.

56. The method of claim 55, wherein the driving at least a portion of the entry segment and the first extension segment into the ground is accomplished by direct push.

57. The method of claim 55 wherein the driving at least a portion of the entry segment and the first extension segment into the ground is accomplished by sonic drilling.

58. The method of claim 55 wherein the driving at least a portion of the entry segment and the first extension segment into the ground is accomplished by a combination of direct push and sonic drilling.

59. The method of claim 55 wherein the selectively coupling additional extension segments to the first extension segment to lengthen the insertion chain as the entry segment is driven to the selected depth in the ground, comprises selectively coupling addition extension segments to lengthen the insertion chain until the entry segment reaches a desired depth.

60. The method of claim 55 wherein after selectively coupling additional extension segments to the first extension segment to lengthen the insertion chain as the entry segment is driven to the selected depth in the ground, the method further comprises placing data retrieval equipment into the insertion chain cavity so that, locations adjacent to the insertion chain may be viewed through the transparent portions of the sidewalls of the extension segments.

61. The method of claim 55 wherein after selectively coupling addition extension segments to lengthen the insertion chain as the entry segment is driven to the selected depth in the ground, the method further comprises selectively coupling a field cap to the upper end of the insertion chain.

62. The method of claim 55 wherein before driving at least a portion of the entry segment and the first extension segment into the ground, the method further comprises providing a pressure cap which is selectively coupled to the first extension segment to selectively test the integrity of the insertion chain cavity.

63. The method of claim 62 wherein before selectively coupling addition extension segments to lengthen the insertion chain as the entry segment is driven to the selected depth in the ground, the method further comprises pressurizing the insertion chain cavity by adding a gas into the insertion chain cavity using a selectively operable valve so that the insertion chain cavity is under a pressure; and evaluating the integrity of the insertion chain cavity by testing the ability of the insertion chain cavity to maintain the pressure.

64. A method for placing a visual probe into a subsurface area, comprising:

providing an entry segment configured to be driven into a ground, the entry segment having a tip end and an attachment end;

providing a plurality of extension segments which are configured to be selectively coupled in series to the entry segment to form an insertion chain as the entry segment is driven progressively deeper into the ground, wherein each extension segment has a first end, a second end and a sidewall which extends between the first and second ends, at least a portion of the sidewall being transparent, the first and second ends and the sidewall defining a central cavity, the first end of one extension segment being configured to selectively couple with the second end of another extension segment;

selectively coupling a first end of a first extension segment with the attachment end of the entry segment to begin forming the insertion chain;

after selectively coupling the first end of the first extension segment with the attachment end of the entry segment to begin forming the insertion chain, driving at least a portion of the entry segment and the first extension segment into the ground; and after driving at least a portion of the entry segment and the first extension segment into the ground, selectively coupling additional extension segments to the first extension segment to lengthen the insertion chain as the entry segment is driven progressively deeper into the ground to a selected depth, the central cavities of each respective extension segment which have been selectively coupled to form the insertion chain together defining an insertion chain cavity.

65. The method of claim 64 wherein before driving the portion of the entry segment and the first extension segment into the ground, the method further comprises providing a pressure cap which is selectively coupled to the second end of the first extension segment.

66. The method of claim 65 and further comprising after providing the pressure cap and before driving the portion of the entry segment and the first extension segment into the ground, adding a gas into the insertion chain cavity so that the insertion chain cavity is under a pressure; and after driving the portion of the entry segment and the first extension segment to the ground, and before selectively coupling additional extension segments to the first extension segment, evaluating the integrity of the insertion chain cavity by pressure testing the insertion chain cavity to ensure that the insertion chain cavity has not been breached, whereby spreading of contamination to ground surface can be avoided.

67. The method of claim 66 and further comprising, before selectively coupling additional extension segments to the first extension segment to lengthen the insertion chain as the entry segment is driven progressively deeper into the ground to the selected depth, evaluating the integrity of the insertion chain cavity by sequentially testing the ability of the insertion chain cavity to maintain containment as each additional extension segment is added to the insertion chain and driven into the ground.

68. The method of claim 64 and further comprising, after selectively coupling additional extension segments to the first extension segment to lengthen the insertion chain as the entry segment is driven progressively deeper into the ground to a selected depth, placing data gathering equipment into the insertion chain cavity to gather subsurface information through the transparent portions of the sidewalls of the extension segments which have been selectively coupled to form the insertion chain.

69. The method of claim 64 and further comprising, after selectively coupling additional extension segments to the first extension segment to lengthen the insertion chain as the entry segment is driven progressively deeper into the ground to a selected depth, selectively coupling a field cap to the second end of an extension segment which was most recently added to the insertion chain.

70. The method of claim 69 and further comprising, providing a selectively operable valve on the field cap which allows gas to be added or released from the insertion chain cavity while the field cap is in place.

71. The method of claim 64, wherein the driving at least a portion of the entry segment and the first extension segment into the ground is accomplished by direct push.

72. The method of claim 64 wherein the driving at least a portion of the entry segment and the first extension segment into the ground is accomplished by sonic drilling.

73. The method of claim 64 wherein the driving at least a portion of the entry segment and the first extension segment into the ground is accomplished by a combination of direct push and sonic drilling.

74. The method of claim 64 wherein the selectively coupling addition extension segments to the first extension segment to lengthen the insertion chain as the entry segment is driven progressively deeper into the ground to a selected depth, comprises selectively coupling addition extension segments to lengthen the insertion chain until the entry segment reaches a selected depth.

75. A method for placing a visual probe into a subsurface area, comprising:

providing an entry segment configured to be driven into a ground, the entry segment having a tip end, an attachment end, and a push rod attachment point;

providing a plurality of extension segments, each extension segment having a first end, a second end and a sidewall which extends between the first and second ends, at least a portion of the sidewall being transparent, the first and second ends and the sidewall of each respective extension segment defining a central cavity, the first end of one extension segment being configured to selectively couple with the second end of another extension segment, the central cavities of respective extension segments which are selectively coupled together defining an insertion chain cavity;

providing a plurality of push rods which are configured to be selectively coupled to form a push rod string as the entry segment is driven deeper into the ground, each push rod having a first end, a body portion, and a second end;

selectively coupling a first end of a first extension segment to the attachment end of the entry segment to begin forming an insertion chain;

selectively coupling a first end of a first push rod to the push rod attachment point of the entry segment to begin forming a push rod string;

after selectively coupling a first end of the first push rod to the push rod attachment point of the entry segment to begin forming a push rod string, and after selectively coupling a first end of the first extension segment to the attachment end of the entry segment to begin forming an insertion chain, selectively coupling a pressure cap to the second end of the first extension segment to substantially seal the insertion chain cavity for pressure testing, the pressure cap including a selectively operable valve;

after providing the pressure cap, adding a gas into the insertion chain cavity using the selectively operable valve to pressure test the insertion chain cavity;

releasing pressure from the insertion chain cavity;

driving at least a portion of the entry segment and the first extension segment into the ground;

after driving the portion of the entry segment and the first extension segment into the ground, evaluating the integrity of the insertion chain cavity by testing the ability of the insertion chain cavity to maintain the pressure to ensure that contamination does not reach ground surface; and after evaluating the ability of the insertion chain cavity to maintain the pressure, sequentially selectively coupling additional extension segments to lengthen the insertion chain, and sequentially selectively coupling additional push rods to lengthen the push rod string as the entry segment is driven progressively deeper into the ground, while testing the ability of the insertion chain cavity to maintain a pressure as the additional extension segments and the additional push rods are sequentially added.

76. A method for placing a visual probe into a subsurface area, comprising:

providing an entry segment configured to be driven into a ground, the entry segment having a tip end, an attachment end, and a push rod receiving point;

providing an extension segment having a first end, a second end and a transparent cylindrical sidewall which extends between the first and second ends, the sidewall being transparent, and wherein the first and second ends and the transparent cylindrical sidewall together define in part a central cavity, and wherein the first end of the extension segment being configured to selectively couple with the attachment end of the entry segment;

selectively coupling a first end of a first extension segment with the attachment end of the entry segment to begin forming an insertion chain;

providing an entry segment push rod, the entry segment push rod having a leading end, a connection tube having an outer wall, and a trailing end, and wherein the connection tube includes a gas passageway, and has a plurality of gas openings which are coupled in fluid flowing relation to the gas passageway and extend through the outer wall of the connection tube;

selectively coupling the leading end of the entry segment push rod with the push rod receiving point;

after selectively coupling the leading end of the entry segment push rod to the push rod attachment point, and after selectively coupling a first end of the first extension segment to the attachment end of the entry segment, providing a pressure cap which is selectively coupled to the second end of the extension segment, and wherein the pressure cap includes a selectively operable valve;

after providing the pressure cap, adding a gas into the central cavity using the selectively operable valve to pressure test the central cavity;

releasing pressure from the central cavity;

after releasing pressure from the central cavity, driving at least a portion of the entry segment and the first extension segment into the ground; and after driving at least a portion of the entry segment and the first extension segment into the ground, evaluating the integrity of the visual probe by testing the ability of the central cavity to maintain the pressure.

77. The method of claim 76 wherein the driving at least a portion of the entry segment and the first extension segment into the ground is accomplished by direct push.

78. The method of claim 76 wherein the driving at least a portion of the entry segment and the first extension segment into the ground is accomplished by sonic drilling.

79. The method of claim 76 wherein the driving at least a portion of the entry segment and the first extension segment into the ground is accomplished by a combination of direct push and sonic drilling.

80. The method of claim 76 and further comprising:

providing a plurality of extension segments which are configured to be sequentially selectively coupled to the insertion chain as the entry segment is driven progressively deeper into the ground;

providing a plurality of extension segment push rods which are configured to be sequentially selectively coupled to the trailing end of the entry segment push rod to form a push rod string as the entry segment is driven deeper into the ground;

evaluating the integrity of the visual probe by testing the ability of the central cavity to maintain the pressure before each additional extension segment is added to the insertion chain; and evaluating the integrity of the visual probe by testing the ability of the central cavity to maintain the pressure after each additional extension segment is driven into the ground.

81. The method of claim 76 and further comprising providing visual data capture equipment in the visual probe and using the visual data capture equipment to determine spacial relationships between subsurface objects.

82. The method of claim 76 and further comprising providing visual data capture equipment in the visual probe and moving the visual data capture equipment within the probe to determine spacial relationships between subsurface objects.

83. The method of claim 76 and further comprising providing data capture equipment in the visual probe and using the data capture equipment to determine below ground topology information.

84. A visual probe for gathering data from subsurface areas, comprising:

an entry segment having a tip end configured for insertion into the ground and an attachment end;

a plurality of extension segments which are configured to be selectively coupled in series to the attachment end of the entry segment to form an insertion chain as the entry segment is driven progressively deeper into the ground; each extension segment having first and second ends which are open and a transparent cylindrical sidewall which extends between the first and second ends, the transparent cylindrical sidewall and the first and second ends together defining in part a central cavity; the first end of one extension segment being configured to selectively couple with the second end of another extension segment at an extension segment joint as the insertion chain is formed, the insertion chain having an insertion chain cavity which is defined by the central cavities of each of the extension segments which have been selectively coupled to form the insertion chain, and an extension segment support structure positioned within the central cavity, interior of the cylindrical sidewall, the extension segment support structure including a first hub portion; a second hub portion attached to the second extension segment hub; and a plurality of rods extending between the first and second hub portions, the plurality of rods being radially positioned within the central cavity to define an extension segment push rod cavity for receipt of visual data capture equipment movable along the direction of insertion of the visual probe.

85. A visual probe in accordance with claim 83 and further comprising markings along the length of the cylindrical sidewall for use in correlating objects below ground, using the visual data capture equipment to provide a data spacial reference of depth of an object relative to ground surface.

* * * * *